US009429124B2

(12) United States Patent
Pursifull et al.

(10) Patent No.: US 9,429,124 B2
(45) Date of Patent: Aug. 30, 2016

(54) DIRECT INJECTION FUEL PUMP

(71) Applicant: Ford Global Technologies, LLC, Dearborn, MI (US)

(72) Inventors: Ross Dykstra Pursifull, Dearborn, MI (US); Joseph Norman Ulrey, Dearborn, MI (US); Robin Ivo Lawther, Chelmsford (GB); Paul Zeng, Inkster, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 403 days.

(21) Appl. No.: 14/198,082

(22) Filed: Mar. 5, 2014

(65) Prior Publication Data

US 2014/0224209 A1 Aug. 14, 2014

Related U.S. Application Data

(63) Continuation-in-part of application No. 13/830,022, filed on Mar. 14, 2013.

(60) Provisional application No. 61/763,881, filed on Feb. 12, 2013.

(51) Int. Cl.
*F02M 59/46* (2006.01)
*F04B 11/00* (2006.01)
(Continued)

(52) U.S. Cl.
CPC ..... *F02M 63/0001* (2013.01); *F02M 59/367* (2013.01); *F02M 63/0265* (2013.01);
(Continued)

(58) Field of Classification Search
CPC ..... F04B 39/0027; F04B 39/0038; F04B 39/005; F04B 39/0055; F04B 39/0061; F04B 39/0066; F04B 11/00; F04B 11/0008; F04C 29/061; F04C 29/065; F04D 29/663; F04D 29/665; F02M 2037/0005; F02M 37/0029; F02M 37/0041; F02M 37/0047; F02M 37/0058; F02M 37/0064; F02M 37/0076; F02M 37/06; F02M 37/04; F02M 2037/087; F02M 45/063; F02M 39/00; F02M 57/00; F02M 59/02; F02M 59/025; F02M 59/027; F02M 59/102; F02M 63/0001; F02M 59/0367; F02M 63/0265; F02M 2200/02; F02M 2200/03; F02M 2200/09; F02M 2200/40
USPC ..... 123/447, 445, 446, 448, 449, 450, 451, 123/452, 456, 457, 338, 339.1, 363, 364, 123/365, 369, 375, 401, 458, 459, 460, 472, 123/492, 493, 495, 497, 496, 500, 501, 503, 123/506, 507, 508, 510, 511, 512, 515; 417/312, 540, 543, 218, 221, 258, 399
See application file for complete search history.

(56) References Cited

U.S. PATENT DOCUMENTS 4,378,775 A * 4/1983 Straubel ..... F02M 59/366 123/446
4,643,155 A * 2/1987 O'Neill ..... F02D 41/14 123/496

(Continued)

FOREIGN PATENT DOCUMENTS

EP 2143916 A1 1/2010
EP 2431597 A1 3/2012
WO 2012059267 A1 5/2012

OTHER PUBLICATIONS

Stickler, Mark L. et al., "Pressure Device to Reduce Ticking Noise During Engine Idling," U.S. Appl. No. 14/286,648, filed May 23, 2014, 58 pages.

(Continued)

*Primary Examiner* — Thomas Moulis
*Assistant Examiner* — John Bailey
(74) *Attorney, Agent, or Firm* — Julia Voutyras; Alleman Hall McCoy Russell & Tuttle LLP

(57) ABSTRACT

Methods and systems are provided for a direct injection fuel pump. The methods and system control pressure within a compression chamber so as to improve fuel pump lubrication.

11 Claims, 13 Drawing Sheets

(51) Int. Cl.
*F02M 63/00* (2006.01)
*F02M 59/36* (2006.01)
*F02M 63/02* (2006.01)

(52) U.S. Cl.
CPC ..... *F02M2200/02* (2013.01); *F02M 2200/03* (2013.01); *F02M 2200/09* (2013.01); *F02M 2200/40* (2013.01)

(56) References Cited

U.S. PATENT DOCUMENTS 5,257,606 A 11/1993 Willman et al.
5,603,303 A * 2/1997 Okajima ..... F01L 1/053 123/508
6,024,064 A 2/2000 Kato et al.
6,138,638 A 10/2000 Morikawa
6,142,747 A 11/2000 Rosenau et al.
6,439,202 B1 * 8/2002 Carroll, III ..... F02D 41/3836 123/300
6,964,262 B2 11/2005 Hayakawa
7,216,627 B2 5/2007 Ito et al.
7,463,967 B2 12/2008 Ancimer et al.
7,536,997 B2 5/2009 Koehler et al.
7,610,902 B2 * 11/2009 Beardmore ..... F02M 59/44 123/467
7,827,967 B2 * 11/2010 Beardmore ..... F02M 59/102 123/503
8,091,530 B2 1/2012 Surnilla et al.
8,091,540 B2 1/2012 Surnilla et al.
8,245,694 B2 8/2012 Kuhnke et al.
8,590,510 B2 11/2013 Surnilla et al.
9,284,931 B2 * 3/2016 Brostrom ..... F02D 41/3845
2002/0078928 A1 * 6/2002 Onishi ..... F02D 41/1462 123/458
2002/0148443 A1 * 10/2002 Kojima ..... F02D 41/009 123/446
2002/0170539 A1 * 11/2002 Rembold ..... F02M 55/04 123/458
2004/0025830 A1 * 2/2004 Draper ..... F02M 45/02 123/299
2004/0231335 A1 * 11/2004 Tochiyama ..... F02M 59/366 60/740
2005/0205065 A1 * 9/2005 Rembold ..... F02M 63/0036 123/446
2008/0149076 A1 * 6/2008 Wolber ..... F02M 31/125 123/557
2008/0198529 A1 * 8/2008 Rembold ..... F02D 41/20 361/195
2009/0065292 A1 * 3/2009 Beardmore ..... F02M 59/44 181/175
2009/0068041 A1 * 3/2009 Beardmore ..... F02M 55/04 417/540
2010/0050989 A1 * 3/2010 Williams ..... F02M 55/04 123/447
2011/0011369 A1 1/2011 Jaasma et al.
2011/0125387 A1 * 5/2011 Suzuki ..... F02D 41/126 701/103
2011/0126804 A1 * 6/2011 Lucas ..... F02M 59/366 123/456
2011/0209687 A1 * 9/2011 Schroeder ..... F02M 63/005 123/459
2011/0315005 A1 * 12/2011 Oikawa ..... F02M 59/46 91/420
2012/0048242 A1 3/2012 Surnilla et al.
2012/0167859 A1 * 7/2012 Basmaji ..... F02D 19/0605 123/456
2013/0125867 A1 5/2013 Krug
2013/0233284 A1 * 9/2013 Thaysen ..... F02D 19/0615 123/495
2014/0305410 A1 * 10/2014 Lucas ..... F02M 59/367 123/456
2015/0027403 A1 * 1/2015 Porten ..... F02D 41/062 123/299

OTHER PUBLICATIONS

Pursifull, Ross D. et al., "Direct Injection Fuel Pump," U.S. Appl. No. 13/830,022, filed Mar. 14, 2013, 50 pages.
Brostrom, Patrick et al., "Engine Fuel Pump and Method for Operation Thereof," U.S. Appl. No. 13/950,181, filed Jul. 24, 2013, 34 pages.
"Flow Controls for Plastic," Lee Company Product Catalog, pp. 116-117, The Lee Company, Westbrook, CT, 1 page.

* cited by examiner

DIRECT INJECTION FUEL PUMP

CROSS REFERENCE TO RELATED APPLICATIONS

The present application is a continuation-in-part of U.S. patent application Ser. No. 13/830,022, "DIRECT INJECTION FUEL PUMP," filed on Mar. 14, 2013, which claims priority to U.S. Provisional Patent Application No. 61/763,881, "DIRECT INJECTION FUEL PUMP," filed on Feb. 12, 2013, the entire contents of each of which are incorporated herein by reference for all purposes.

BACKGROUND AND SUMMARY

A vehicle's fuel systems may supply fuel to an engine in varying amounts during the course of vehicle operation. During some conditions, fuel is not injected to the engine but fuel pressure in a fuel rail supplying fuel to the engine is maintained so that fuel injection can be reinitiated. For example, during vehicle deceleration fuel flow to one or more engine cylinders may be stopped by deactivating fuel injectors. If the engine torque demand is increased after fuel flow to the one or more cylinders ceases, fuel injection is reactivated and the engine resumes providing positive torque to the vehicle driveline. However, if the engine is supplied fuel via direct fuel injectors and a high pressure fuel pump, the high pressure pump may degrade when fuel flow through the high pressure pump is stopped while the fuel injectors are deactivated. Specifically, the lubrication and cooling of the pump may be reduced while the high pressure pump is not operated, thereby leading to pump degradation. Besides deceleration, a direct injection fuel system may periodically cease operation because a different set of fuel injectors are supplying the engine with fuel (as may be the case with a bi-fuel engine). Also, if an electric motor is handling the vehicle's torque needs, fuel injection may cease during that operational mode.

The inventors herein have recognized the above-mentioned issue may be at least partly addressed by a method of operating a direct injection fuel pump, comprising: regulating a pressure in a compression chamber of the direct injection fuel pump to a limited pressure during a direct injection fuel pump compression stroke, the pressure greater than an the pressure on the low pressure side of the piston. This pressure limit may be the output pressure of a low pressure pump supplying fuel to the direct injection fuel pump. Furthermore, another method of operating a direct injection fuel pump is provided, comprising: while a solenoid activated check valve at an inlet of the direct injection fuel pump is commanded to a pass-through state during a direct injection fuel pump compression stroke, an accumulator located upstream of the solenoid activated check valve is in fluidic communication with a compression chamber of the direct injection fuel pump, the accumulator adding a volume to a clearance volume of the direct injection fuel pump.

By regulating pressure in the compression chamber of a direct injection fuel pump it may be possible to lubricate the direct injection fuel pump's cylinder and piston when flow out of the direct injection fuel pump to fuel injectors is stopped. Specifically, a fuel pressure differential across the direct injection fuel pump's piston may be provided that allows fuel to flow into the piston/bore clearance and lubricate an area. Further, pressure in the compression chamber is less than pressure in the fuel rail so there is no flow from the direct injection fuel pump to the fuel rail. In this way, the piston may continue to reciprocate within the direct injection fuel pump with a low rate of degradation and without supplying fuel to the engine.

The present description may provide several advantages. Specifically, the approach may improve fuel pump lubrication and reduce fuel pump degradation. Additionally, pressure in the compression chamber can be regulated to a higher pressure than low pressure fuel pump pressure so that engine operation may be improved during conditions of direct injection fuel pump degradation. Further, the approach may be applied at low cost and complexity. Further still, the approach may reduce fuel pump noise since a solenoid activated check valve at an inlet of the direct injection fuel pump may be deactivated when fuel flow to the engine is stopped. Additionally, several embodiments of direct injection fuel pumps and fuel systems are presented in the Detailed Description below that include accumulators, check valves, and other components and modifications that may create better pump performance while alleviating problems such as pump reflux, noise pollution, and pump degradation caused by inadequate pump lubrication. Adding check valves and accumulators to fuel systems may reduce the adverse effects associated with pump reflux, such as increased stress to the system as well as unnecessarily increased pumping pressure. Furthermore, including an accumulator to the direct injection fuel pump may aid in reducing pump noise while maintaining sufficient lubrication of the pump.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
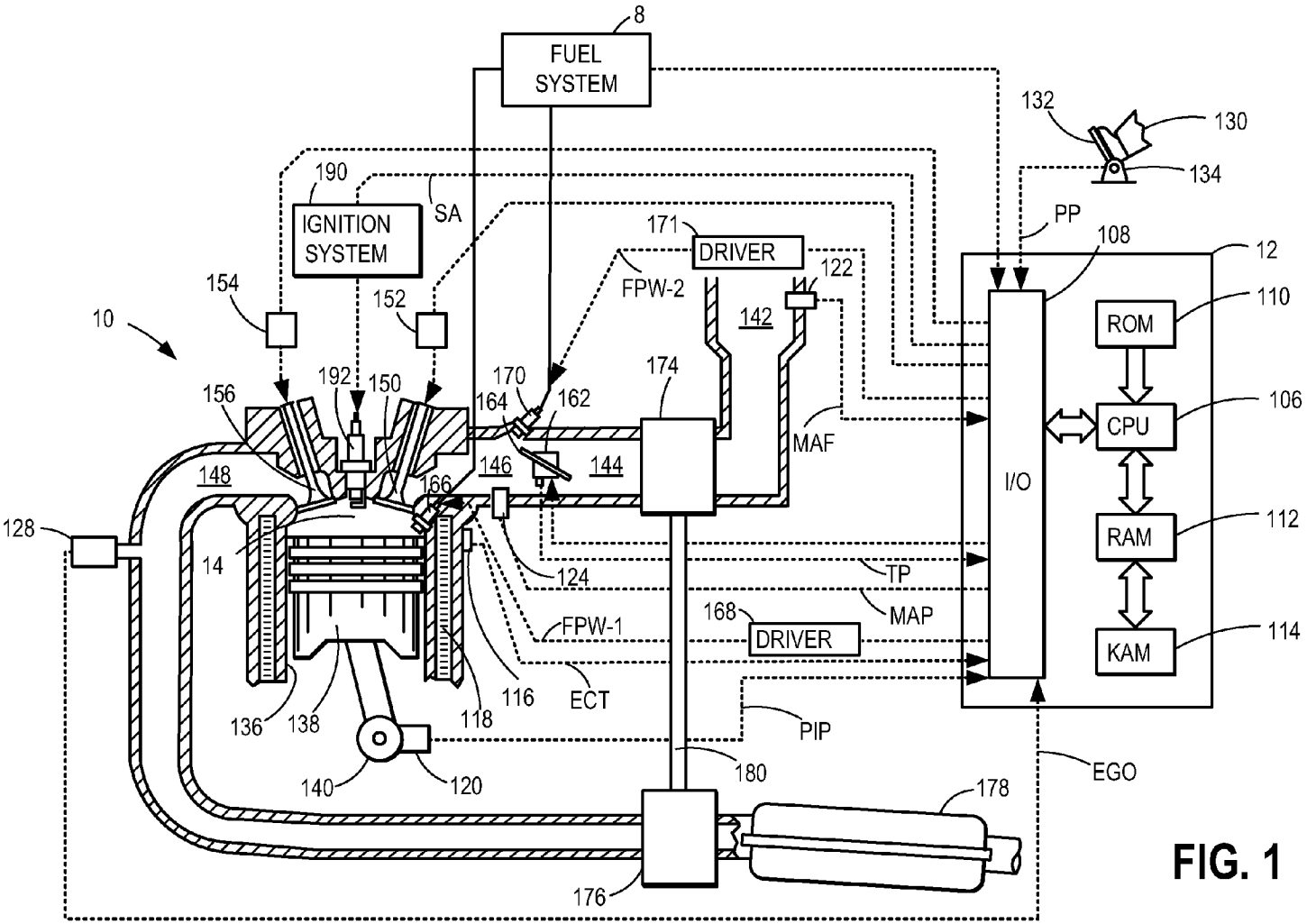
FIG. 1 shows an example of a cylinder of an internal combustion engine.
Figure 2:
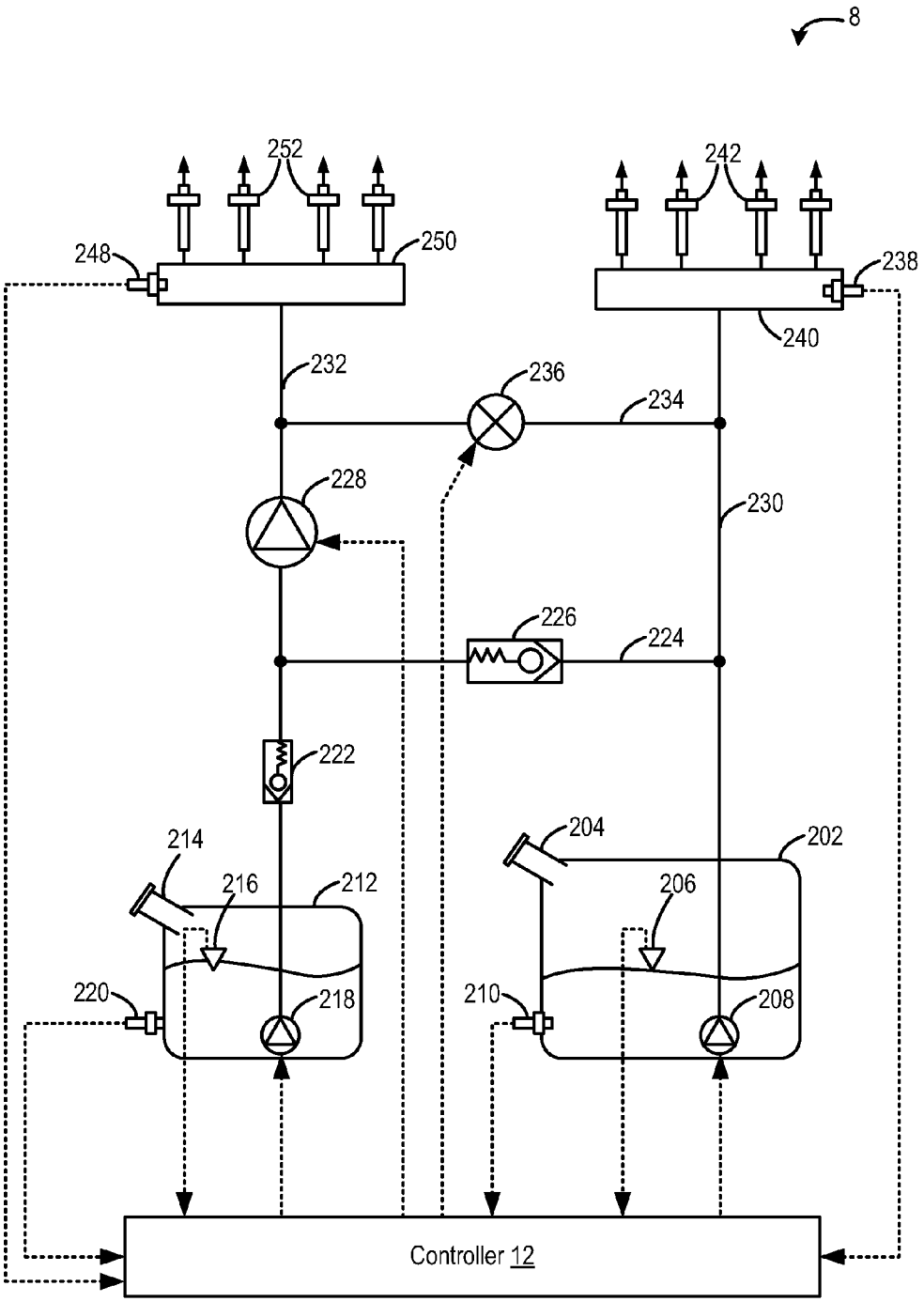
FIG. 2 shows an example of a fuel system that may be used with the engine of FIG. 1.
Figure 3:
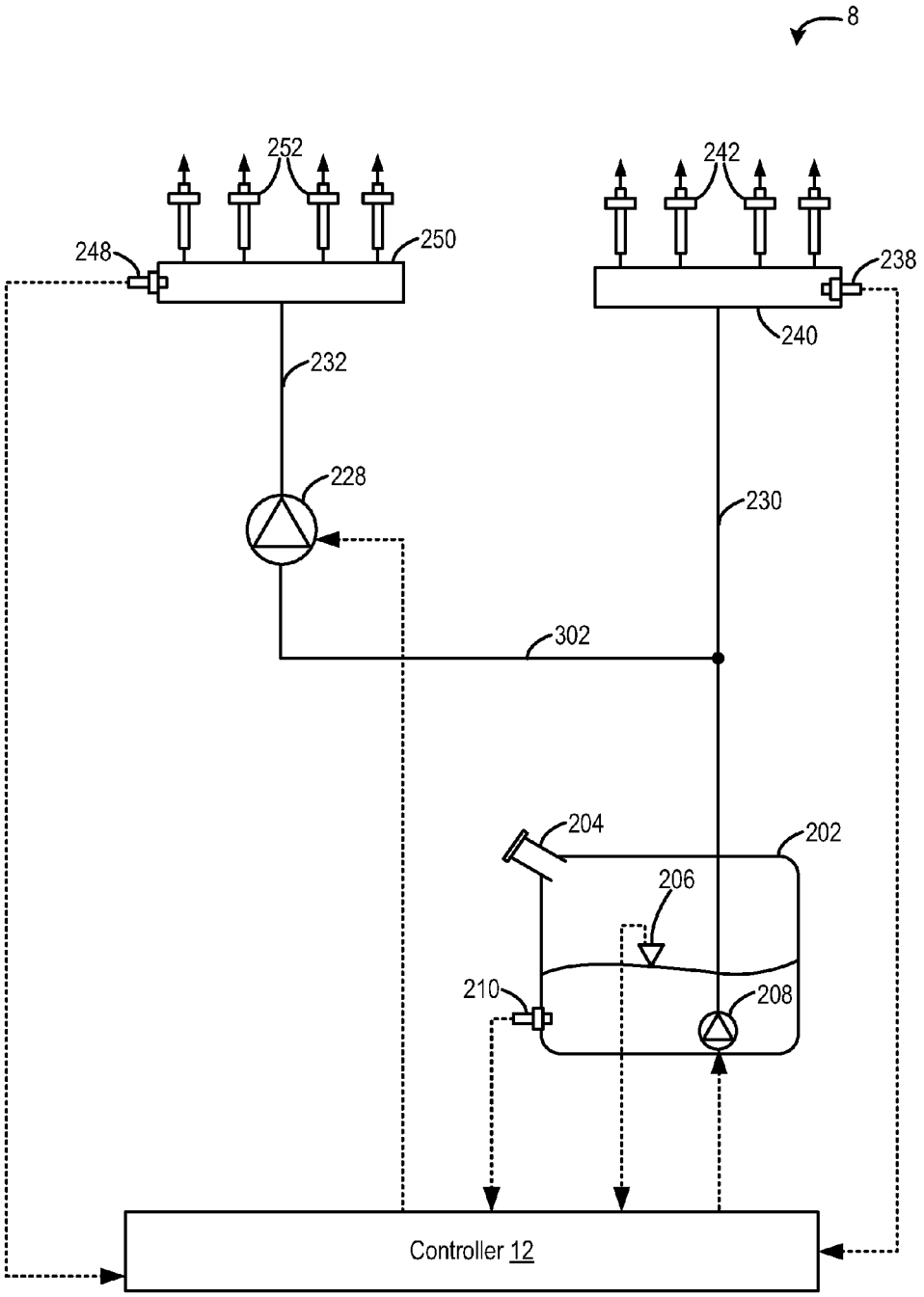
FIG. 3 shows another example of a fuel system that may be used with the engine of FIG. 1.
Figure 4:
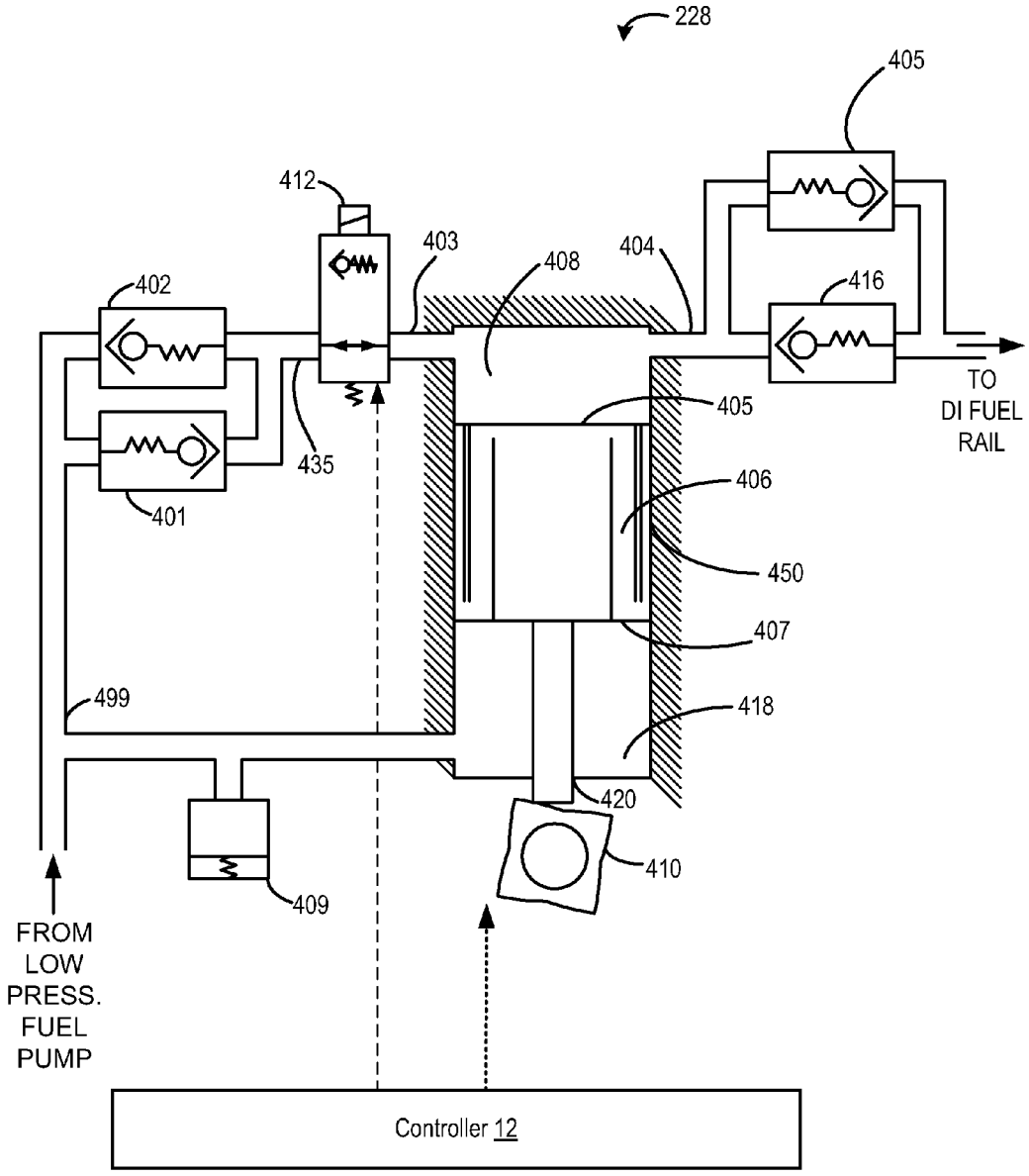
FIG. 4 shows an example of a high pressure direct injection fuel pump of the fuel system of FIGS. 2 and 3.
Figure 5A:
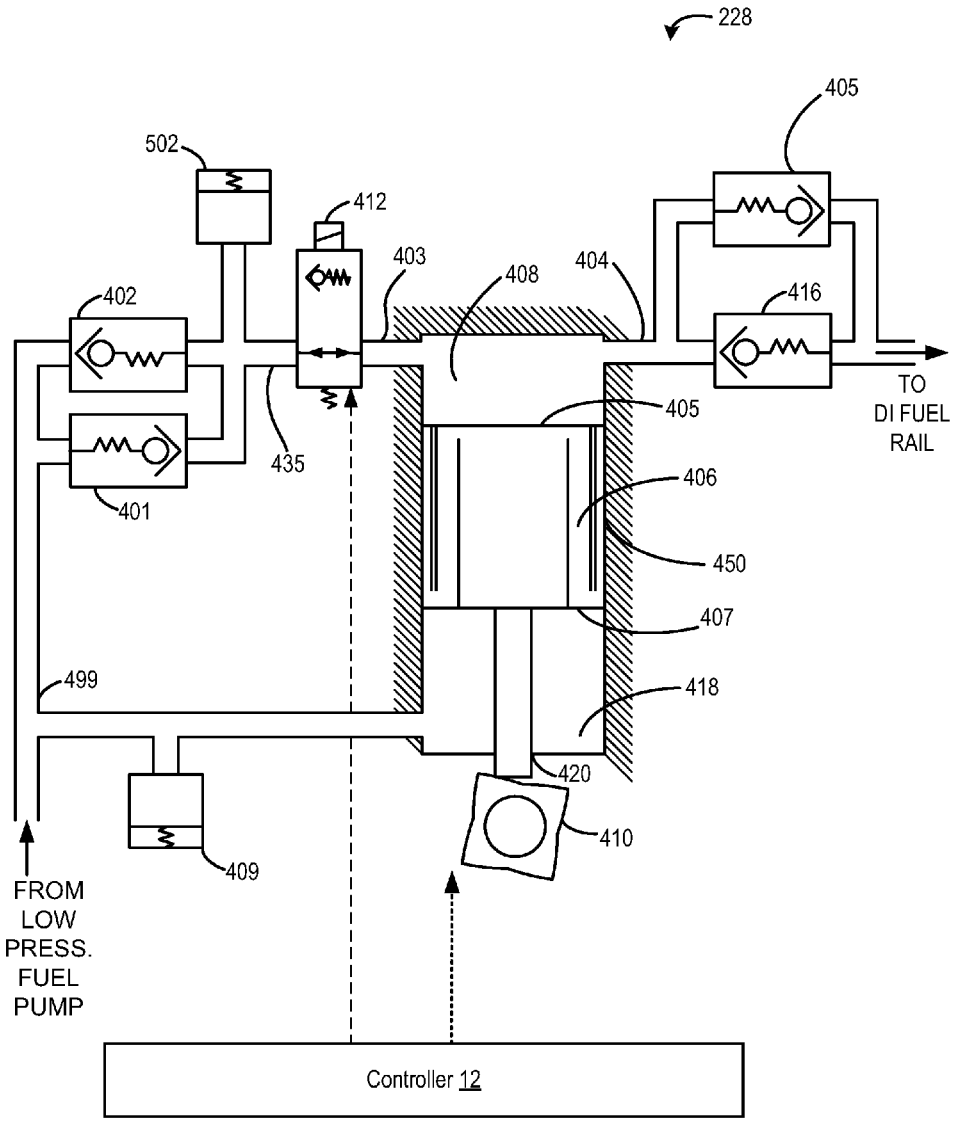
FIG. 5A shows another example of a high pressure direct injection fuel pump of the fuel system in FIGS. 2 and 3.
Figure 5B:
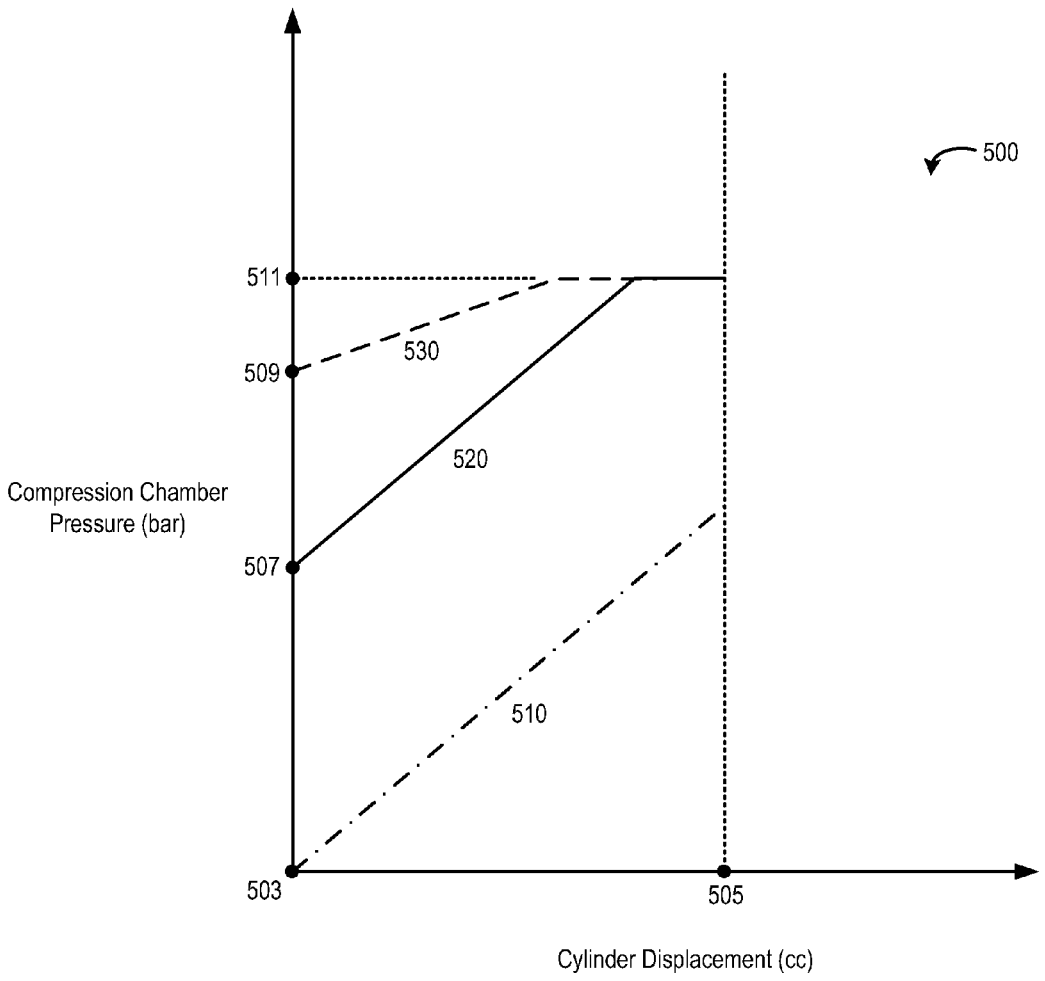
FIG. 5B shows a pressure-volume diagram of the pump of FIG. 5A.
Figure 12:
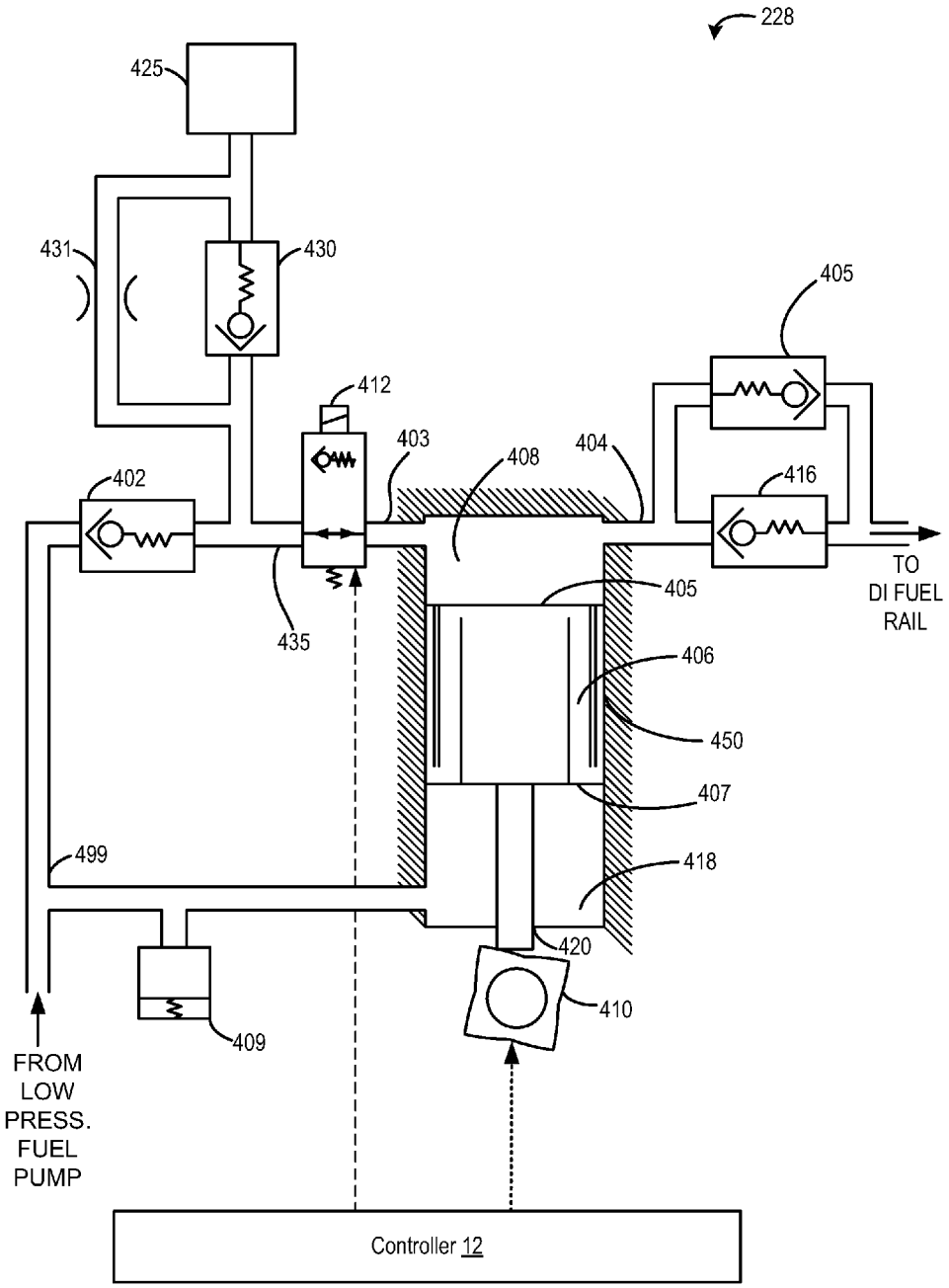
FIG. 12 shows another example of a high pressure direct injection fuel pump of the fuel system of FIGS. 2 and 3.

The following disclosure relates to methods and systems for operating a direct injection (high pressure, HP) fuel pump, such as the system of FIGS. 2 and 3. The fuel system may be configured to deliver one or more different fuel types to a combustion engine, such as the engine of FIG. 1. Alternatively, the fuel system may supply a single type of fuel as shown in the system of FIG. 3. A direct injection fuel pump with integrated pressure relief and check valves as shown in FIG. 4 may be incorporated into the systems of FIGS. 2 and 3. Alternatively, the pressure relief valves and check valves may be external to the direct injection fuel pump. In some examples, the direct injection fuel pump may further include an accumulator as shown in FIG. 5A to further enhance direct injection fuel pump operation. A variety of graphs may exist for different pre-pressurizations of the accumulator, where the associated pressure-volume diagram of which is shown in FIG. 5B. The direct injection fuel pumps may operate as shown if FIGS. 6-8 when fuel is not being supplied to the engine while the engine is rotating. FIG. 9 shows a method for operating a direct injection fuel pump in the systems of FIGS. 2 and 3 to provide the sequences shown in FIGS. 7 and 8. Another embodiment of the direct injection fuel pump with an accumulator (or dead volume) is shown in FIG. 12 along with a relationship to determine the size of the accumulator in FIG. 13. Lastly, another embodiment of a high pressure fuel pump that at least partially addresses the issues associated with pump reflux is shown in FIG. 14.

FIG. 1 depicts an example of a combustion chamber or cylinder of internal combustion engine 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder (herein also "combustion chamber') 14 of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system. Further, a starter motor (not shown) may be coupled to crankshaft 140 via a flywheel to enable a starting operation of engine 10.

Cylinder 14 can receive intake air via a series of intake air passages 142, 144, and 146. Intake air passage 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake passages 142 and 144, and an exhaust turbine 176 arranged along exhaust passage 148. Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust passage 148 can receive exhaust gases from other cylinders of engine 10 in addition to cylinder 14. Exhaust gas sensor 128 is shown coupled to exhaust passage 148 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing or fixed cam timing may be used. Each cam actuation system may include one or more cams and may utilize one or more of cam profile switching (CPS), variable cam timing (VCT), variable valve timing (VVT) and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

Cylinder 14 can have a compression ratio, which is the ratio of volumes when piston 138 is at bottom center to top center. In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. However, in some embodiments, spark plug 192 may be omitted, such as where engine 10 may initiate combustion by auto-ignition or by injection of fuel as may be the case with some diesel engines.

In some examples, each cylinder of engine 10 may be configured with one or more fuel injectors for providing fuel thereto. As a non-limiting example, cylinder 14 is shown including two fuel injectors 166 and 170. Fuel injectors 166 and 170 may be configured to deliver fuel received from fuel system 8. As elaborated with reference to FIGS. 2 and 3, fuel system 8 may include one or more fuel tanks, fuel pumps, and fuel rails. Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. While FIG. 1 shows injector 166 positioned to one side of cylinder 14, it may alternatively be located overhead of the piston, such as near the position of spark plug 192. Such a position may improve mixing and combustion when operating the engine with an alcohol-based fuel due to the lower volatility of some alcohol-based fuels. Alternatively, the injector may be located overhead and near the intake valve to improve mixing. Fuel may be delivered to fuel injector 166 from a fuel tank of fuel system 8 via a high pressure fuel pump, and a fuel rail. Further, the fuel tank may have a pressure transducer providing a signal to controller 12.

Fuel injector 170 is shown arranged in intake passage 146, rather than in cylinder 14, in a configuration that provides what is known as port injection of fuel (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85 (which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

In still another example, both fuels may be alcohol blends with varying alcohol composition wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities such as a difference in temperature, viscosity, octane number, etc. Moreover, fuel characteristics of one or both fuel tanks may vary frequently, for example, due to day to day variations in tank refilling. In another example, gaseous fuel may be used for the first fuel while a liquid fuel is used for the second fuel, or both fuels may be in a gaseous state. Gaseous fuels may include, but are not limited to, hydrogen, natural gas, and propane.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold.

FIG. 2 schematically depicts an example fuel system 8 of FIG. 1. Fuel system 8 may be operated to deliver fuel to an engine, such as engine 10 of FIG. 1. Fuel system 8 may be operated by a controller to perform some or all of the operations described with reference to the process flow of FIG. 9.

Fuel system 8 can provide fuel to an engine from one or more different fuel sources. As a non-limiting example, a first fuel tank 202 and a second fuel tank 212 may be provided. While fuel tanks 202 and 212 are described in the context of discrete vessels for storing fuel, it should be appreciated that these fuel tanks may instead be configured as a single fuel tank having separate fuel storage regions that are separated by a wall or other suitable membrane. Further still, in some embodiments, this membrane may be configured to selectively transfer select components of a fuel between the two or more fuel storage regions, thereby enabling a fuel mixture to be at least partially separated by the membrane into a first fuel type at the first fuel storage region and a second fuel type at the second fuel storage region.

In some examples, first fuel tank 202 may store fuel of a first fuel type while second fuel tank 212 may store fuel of a second fuel type, wherein the first and second fuel types are of differing composition. As a non-limiting example, the second fuel type contained in second fuel tank 212 may include a higher concentration of one or more components that provide the second fuel type with a greater relative knock suppressant capability than the first fuel.

By way of example, the first fuel and the second fuel may each include one or more hydrocarbon components, but the second fuel may also include a higher concentration of an alcohol component than the first fuel. Under some conditions, this alcohol component can provide knock suppression to the engine when delivered in a suitable amount relative to the first fuel, and may include any suitable alcohol such as ethanol, methanol, etc. Since alcohol can provide greater knock suppression than some hydrocarbon based fuels, such as gasoline and diesel, due to the increased latent heat of vaporization and charge cooling capacity of the alcohol, a fuel containing a higher concentration of an alcohol component can be selectively used to provide increased resistance to engine knock during select operating conditions.

As another example, the alcohol (e.g. methanol, ethanol) may have water added to it. As such, water reduces the alcohol fuel's flammability giving an increased flexibility in storing the fuel. Additionally, the water content's heat of vaporization enhances the ability of the alcohol fuel to act as a knock suppressant. Further still, the water content can reduce the fuel's overall cost.

As a specific non-limiting example, the first fuel type in the first fuel tank may include gasoline and the second fuel type in the second fuel tank may include ethanol. As another non-limiting example, the first fuel type may include gasoline and the second fuel type may include a mixture of gasoline and ethanol. In still other examples, the first fuel type and the second fuel type may each include gasoline and ethanol, whereby the second fuel type includes a higher concentration of the ethanol component than the first fuel (e.g., E10 as the first fuel type and E85 as the second fuel type). As yet another example, the second fuel type may have a relatively higher octane rating than the first fuel type, thereby making the second fuel a more effective knock suppressant than the first fuel. It should be appreciated that these examples should be considered non-limiting as other suitable fuels may be used that have relatively different knock suppression characteristics. In still other examples, each of the first and second fuel tanks may store the same fuel. While the depicted example illustrates two fuel tanks with two different fuel types, it will be appreciated that in alternate embodiments, only a single fuel tank with a single type of fuel may be present.

Fuel tanks 202 and 212 may differ in their fuel storage capacities. In the depicted example, where second fuel tank 212 stores a fuel with a higher knock suppressant capability, second fuel tank 212 may have a smaller fuel storage capacity than first fuel tank 202. However, it should be appreciated that in alternate embodiments, fuel tanks 202 and 212 may have the same fuel storage capacity.

Fuel may be provided to fuel tanks 202 and 212 via respective fuel filling passages 204 and 214. In one example, where the fuel tanks store different fuel types, fuel filling passages 204 and 214 may include fuel identification markings for identifying the type of fuel that is to be provided to the corresponding fuel tank.

A first low pressure fuel pump (LPP) 208 in communication with first fuel tank 202 may be operated to supply the first type of fuel from the first fuel tank 202 to a first group of port injectors 242, via a first fuel passage 230. In one example, first fuel pump 208 may be an electrically-powered lower pressure fuel pump disposed at least partially within first fuel tank 202. Fuel lifted by first fuel pump 208 may be supplied at a lower pressure into a first fuel rail 240 coupled to one or more fuel injectors of first group of port injectors 242 (herein also referred to as first injector group). While first fuel rail 240 is shown dispensing fuel to four fuel injectors of first injector group 242, it will be appreciated that first fuel rail 240 may dispense fuel to any suitable number of fuel injectors. As one example, first fuel rail 240 may dispense fuel to one fuel injector of first injector group 242 for each cylinder of the engine. Note that in other examples, first fuel passage 230 may provide fuel to the fuel injectors of first injector group 242 via two or more fuel rails. For example, where the engine cylinders are configured in a V-type configuration, two fuel rails may be used to distribute fuel from the first fuel passage to each of the fuel injectors of the first injector group.

Direct injection fuel pump 228 that is included in second fuel passage 232 and may be supplied fuel via LPP 208 or LPP 218. In one example, direct injection fuel pump 228 may be a mechanically-powered positive-displacement pump. Direct injection fuel pump 228 may be in communication with a group of direct injectors 252 via a second fuel rail 250, and the group of port injectors 242 via a solenoid valve 236. Thus, lower pressure fuel lifted by first fuel pump 208 may be further pressurized by direct injection fuel pump 228 so as to supply higher pressure fuel for direct injection to second fuel rail 250 coupled to one or more direct fuel injectors 252 (herein also referred to as second injector group). In some examples, a fuel filter (not shown) may be disposed upstream of direct injection fuel pump 228 to remove particulates from the fuel. Further, in some examples a fuel pressure accumulator (not shown) may be coupled downstream of the fuel filter, between the low pressure pump and the high pressure pump.

A second low pressure fuel pump 218 in communication with second fuel tank 212 may be operated to supply the second type of fuel from the second fuel tank 202 to the direct injectors 252, via the second fuel passage 232. In this way, second fuel passage 232 fluidly couples each of the first fuel tank and the second fuel tank to the group of direct injectors. In one example, third fuel pump 218 may also be an electrically-powered low pressure fuel pump (LPP), disposed at least partially within second fuel tank 212. Thus, lower pressure fuel lifted by low pressure fuel pump 218 may be further pressurized by higher pressure fuel pump 228 so as to supply higher pressure fuel for direct injection to second fuel rail 250 coupled to one or more direct fuel injectors. In one example, second low pressure fuel pump 218 and direct injection fuel pump 228 can be operated to provide the second fuel type at a higher fuel pressure to second fuel rail 250 than the fuel pressure of the first fuel type that is provided to first fuel rail 240 by first low pressure fuel pump 208.

Fluid communication between first fuel passage 230 and second fuel passage 232 may be achieved through first and second bypass passages 224 and 234. Specifically, first bypass passage 224 may couple first fuel passage 230 to second fuel passage 232 upstream of direct injection fuel pump 228, while second bypass passage 234 may couple first fuel passage 230 to second fuel passage 232 downstream of direct injection fuel pump 228. One or more pressure relief valves may be included in the fuel passages and/or bypass passages to resist or inhibit fuel flow back into the fuel storage tanks. For example, a first pressure relief valve 226 may be provided in first bypass passage 224 to reduce or prevent back flow of fuel from second fuel passage 232 to first fuel passage 230 and first fuel tank 202. A second pressure relief valve 222 may be provided in second fuel passage 232 to reduce or prevent back flow of fuel from the first or second fuel passages into second fuel tank 212. In one example, lower pressure pumps 208 and 218 may have pressure relief valves integrated into the pumps. The integrated pressure relief valves may limit the pressure in the respective lift pump fuel lines. For example, a pressure relief valve integrated in first fuel pump 208 may limit the pressure that would otherwise be generated in first fuel rail 240 if solenoid valve 236 were (intentionally or unintentionally) open and while direct injection fuel pump 228 were pumping.

In some examples, the first and/or second bypass passages may also be used to transfer fuel between fuel tanks 202 and 212. Fuel transfer may be facilitated by the inclusion of additional check valves, pressure relief valves, solenoid valves, and/or pumps in the first or second bypass passage, for example, solenoid valve 236. In still other examples, one of the fuel storage tanks may be arranged at a higher elevation than the other fuel storage tank, whereby fuel may be transferred from the higher fuel storage tank to the lower fuel storage tank via one or more of the bypass passages. In this way, fuel may be transferred between fuel storage tanks by gravity without necessarily requiring a fuel pump to facilitate the fuel transfer.

The various components of fuel system 8 communicate with an engine control system, such as controller 12. For example, controller 12 may receive an indication of operating conditions from various sensors associated with fuel system 8 in addition to the sensors previously described with reference to FIG. 1. The various inputs may include, for example, an indication of an amount of fuel stored in each of fuel storage tanks 202 and 212 via fuel level sensors 206 and 216, respectively. Controller 12 may also receive an indication of fuel composition from one or more fuel composition sensors, in addition to, or as an alternative to, an indication of a fuel composition that is inferred from an exhaust gas sensor (such as sensor 126 of FIG. 1). For example, an indication of fuel composition of fuel stored in fuel storage tanks 202 and 212 may be provided by fuel composition sensors 210 and 220, respectively. Additionally or alternatively, one or more fuel composition sensors may be provided at any suitable location along the fuel passages between the fuel storage tanks and their respective fuel injector groups. For example, fuel composition sensor 238 may be provided at first fuel rail 240 or along first fuel passage 230, and/or fuel composition sensor 248 may be provided at second fuel rail 250 or along second fuel passage 232. As a non-limiting example, the fuel composition sensors can provide controller 12 with an indication of a concentration of a knock suppressing component contained in the fuel or an indication of an octane rating of the fuel. For example, one or more of the fuel composition sensors may provide an indication of an alcohol content of the fuel.

Note that the relative location of the fuel composition sensors within the fuel delivery system can provide different advantages. For example, sensors 238 and 248, arranged at the fuel rails or along the fuel passages coupling the fuel injectors with one or more fuel storage tanks, can provide an indication of a resulting fuel composition where two or more different fuels are combined before being delivered to the engine. In contrast, sensors 210 and 220 may provide an indication of the fuel composition at the fuel storage tanks, which may differ from the composition of the fuel actually delivered to the engine.

Controller 12 can also control the operation of each of fuel pumps 208, 218, and 228 to adjust an amount, pressure, flow rate, etc., of a fuel delivered to the engine. As one example, controller 12 can vary a pressure setting, a pump stroke amount, a pump duty cycle command and/or fuel flow rate of the fuel pumps to deliver fuel to different locations of the fuel system. A driver (not shown) electronically coupled to controller 12 may be used to send a control signal to each of the low pressure pumps, as required, to adjust the output (e.g. speed) of the respective low pressure pump. The amount of first or second fuel type that is delivered to the group of direct injectors via the direct injection pump may be adjusted by adjusting and coordinating the output of the first or second LPP and the direct injection pump. For example, the lower pressure fuel pump and the higher pressure fuel pump may be operated to maintain a prescribed fuel rail pressure. A fuel rail pressure sensor coupled to the second fuel rail may be configured to provide an estimate of the fuel pressure available at the group of direct injectors. Then, based on a difference between the estimated rail pressure and a desired rail pressure, the pump outputs may be adjusted. In one example, where the high pressure fuel pump is a volumetric displacement fuel pump, the controller may adjust a flow control valve of the high pressure pump to vary the effective pump volume of each pump stroke.

As such, while the direct injection fuel pump is operating, flow of fuel there-though ensures sufficient pump lubrication and cooling. However, during conditions when direct injection fuel pump operation is not requested, such as when no direct injection of fuel is requested, and/or when the fuel level in the second fuel tank 212 is below a threshold (that is, there is not enough knock-suppressing fuel available), the direct injection fuel pump may not be sufficiently lubricated if fuel flow through the pump is discontinued.

Referring now to FIG. 3, is shows a second example fuel system for supplying fuel to engine 10 of FIG. 1. Many devices and/or components in the fuel system of FIG. 3 are the same as devices and/or components shown in FIG. 2. Therefore, for the sake of brevity, devices and components of the fuel system of FIG. 2, and that are included in the fuel system of FIG. 3, are labeled the same and the description of these devices and components is omitted in the description of FIG. 3.

The fuel system of FIG. 3 supplies fuel from a single fuel tank to direct injectors 252 and port injectors 242. However, in other examples, fuel may be supplied only to direct injectors 252 and port injectors 242 may be omitted. In this example system, low pressure fuel pump 208 supplies fuel to direct injection fuel pump 228 via fuel passage 302. Controller 12 adjusts the output of direct injection fuel pump 228 via adjusting a flow control valve of direct injection pump 228. Direct injection pump may stop providing fuel to fuel rail 250 during selected conditions such as during vehicle deceleration or while the vehicle is traveling downhill. Further, during vehicle deceleration or while the vehicle is traveling downhill, one or more direct fuel injectors 252 may be deactivated.

FIG. 4 shows first example direct injection fuel pump 228 show in the systems of FIGS. 2 and 3. Inlet 403 of direct injection fuel pump compression chamber 408 is supplied fuel via a low pressure fuel pump as shown in FIGS. 2 and 3. The fuel may be pressurized upon its passage through direct injection fuel pump 228 and supplied to a fuel rail through pump outlet 404. In the depicted example, direct injection pump 228 may be a mechanically-driven displacement pump that includes a pump piston 406 and piston rod 420, a pump compression chamber 408 (herein also referred to as compression chamber), and a step-room 418. Piston 406 includes a top 405 and a bottom 407. The step-room and compression chamber may include cavities positioned on opposing sides of the pump piston. In one example, engine controller 12 may be configured to drive the piston 406 in direct injection pump 228 by driving cam 410. Cam 410 includes four lobes and completes one rotation for every two engine crankshaft rotations.

A solenoid activated inlet check valve 412 may be coupled to pump inlet 403. Controller 12 may be configured to regulate fuel flow through inlet check valve 412 by energizing or de-energizing the solenoid valve (based on the solenoid valve configuration) in synchronism with the driving cam. Accordingly, solenoid activated inlet check valve 412 may be operated in two modes. In a first mode, solenoid activated check valve 412 is positioned within inlet 403 to limit (e.g. inhibit) the amount of fuel traveling upstream of the solenoid activated check valve 412. In comparison, in the second mode, solenoid activated check valve 412 is effectively disabled and fuel can travel upstream and downstream of inlet check valve.

As such, solenoid activated check valve 412 may be configured to regulate the mass of fuel compressed into the direct injection fuel pump. In one example, controller 12 may adjust a closing timing of the solenoid activated check valve to regulate the mass of fuel compressed. For example, a late inlet check valve closing may reduce the amount of fuel mass ingested into the compression chamber 408. The solenoid activated check valve opening and closing timings may be coordinated with respect to stroke timings of the direct injection fuel pump.

Pump inlet 499 allows fuel to check valve 402 and pressure relief valve 401. Check valve 402 is positioned upstream of solenoid activated check valve 412 along passage 435. Check valve 402 is biased to prevent fuel flow out of solenoid activated check valve 412 and pump inlet 499. Check valve 402 allows flow from the low pressure fuel pump to solenoid activated check valve 412. Check valve 402 is coupled in parallel with pressure relief valve 401. Pressure relief valve 401 allows fuel flow out of solenoid activated check valve 412 toward the low pressure fuel pump when pressure between pressure relief valve 401 and solenoid operated check valve 412 is greater than a predetermined pressure (e.g., 20 bar). When solenoid operated check valve 412 is deactivated (e.g., not electrically energized), solenoid operated check valve operates in a pass-through mode and pressure relief valve 401 regulates pressure in compression chamber 408 to the single pressure relief setting of pressure relief valve 401 (e.g., 15 bar). Regulating the pressure in compression chamber 408 allows a pressure differential to form from piston top 405 to piston bottom 407. The pressure in step-room 418 is at the pressure of the outlet of the low pressure pump (e.g., 5 bar) while the pressure at piston top is at pressure relief valve regulation pressure (e.g., 15 bar). The pressure differential allows fuel to seep from piston top 405 to piston bottom 407 through the clearance between piston 406 and pump cylinder wall 450, thereby lubricating direct injection fuel pump 228. In this way, the piston top 405 experiences the pressure set by pressure relief valve 402 for the majority of the compression stroke, and on the inlet stroke there is a small pressure difference between the top 405 and bottom 407 of the piston.

Piston 406 reciprocates up and down. Direct fuel injection pump 228 is in a compression stroke when piston 406 is traveling in a direction that reduces the volume of compression chamber 408. Direct fuel injection pump 228 is in a suction stroke when piston 406 is traveling in a direction that increases the volume of compression chamber 408.

A forward flow outlet check valve 416 may be coupled downstream of an outlet 404 of the compression chamber 408. Outlet check valve 416 opens to allow fuel to flow from the compression chamber outlet 404 into a fuel rail only when a pressure at the outlet of direct injection fuel pump 228 (e.g., a compression chamber outlet pressure) is higher than the fuel rail pressure. Thus, during conditions when direct injection fuel pump operation is not requested, controller 12 may deactivate solenoid activated inlet check valve 412 and pressure relief valve 401 regulates pressure in compression chamber to a single substantially constant (e.g., regulation pressure±0.5 bar) pressure. Controller 12 simply deactivates solenoid activated check valve 412 to lubricate direct injection fuel pump 228. One result of this regulation method is that the fuel rail is regulated to approximately the pressure relief of 402. Thus, if valve 402 has a pressure relief setting of 10 bar, the fuel rail pressure becomes 15 bar because this 10 bar adds to the 5 bar of lift pump pressure. Specifically, the fuel pressure in compression chamber 408 is regulated during the compression stroke of direct injection fuel pump 228. Thus, during at least the compression stroke of direct injection fuel pump 228, lubrication is provided to the pump. When direct fuel injection pump enters a suction stroke, fuel pressure in the compression chamber may be reduced while still some level of lubrication may be provided as long as the pressure differential remains.

Now turning to FIG. 5A, another example direct injection fuel pump 228 is shown. Many devices and/or components in the direct injection fuel pump of FIG. 5A are the same as devices and/or components shown in FIG. 4. Therefore, for the sake of brevity, devices and components of the direct fuel injection pump of FIG. 4, and that are included in the direct injection fuel pump of FIG. 5A, are labeled the same and the description of these devices and components is omitted in the description of FIG. 5A.

Direct injection fuel pump 228 includes an accumulator 502 positioned along pump passage 435 between solenoid activated check valve 412 and pressure relief valve 401. In one example, accumulator 502 is a 15 bar accumulator. Thus, accumulator 502 is designed to be active in a pressure range that is below the pressure relief valve 401. Accumulator 502 stores fuel when piston 406 is in a compression stroke and releases fuel when piston is in a suction stroke. Consequently, a pressure differential from piston top 405 to piston bottom 407 exits during compression and suction strokes of direct fuel injection pump 228. Further, when rod is in communication with the position providing least lift from cam 410, the pressure differential is the substantially the same as when direct fuel injection pump 228 is on a compression stroke. Pressure relief valve 401 and accumulator 502 store and release fuel from compression chamber 408 when solenoid activated check valve is deactivated.

The accumulator may be constructed in such a way as to be pre-pressurized, in that prior to the compression stroke of the pump piston, the accumulator maintains a positive pressure. FIG. 5B shows a pressure-volume diagram 500 of the DI pump of FIG. 5A, where the horizontal axis is cylinder displacement while the vertical axis is compression chamber pressure of the pump. Several graphs are shown in diagram 500, each corresponding to a particular accumulator, several of which are pre-pressurized, as described in more detail below. The total displacement of the pump piston may be a common value such as 0.25 cc, shown by 505 in FIG. 5B. Graph 510 shows the pressure-volume relation when a pressure accumulator is used (accumulator 502) that is not pre-pressurized, wherein the graph starts at point 503 (the origin) with a pressure of 0 bar and cylinder displacement of 0 cc, and increases linearly until displacement 0.25 cc is reached. Next, graph 520 shows the relation when a pressure accumulator is used that is pre-pressurized to 14 bar, where the graph starts at point 507 with a pressure of 14 bar. Notice that upon reaching a threshold pressure 511, graph 520 changes slope and becomes horizontal until reaching displacement 505. Threshold pressure 511 may be a value such as 30 bar, representing the setting of compression pressure relief valve 401, which regulates the maximum pressure within the compression chamber 408 and inlet lines 403 and 435. Finally, graph 530 shows the relation when a pressure is used that is pre-pressurized to 26 bar, where the graph starts at point 509 with a pressure of 26 bar and increases until reaching threshold pressure 511 (30 bar).

Notice that the slope of graph 530 in FIG. 5B is substantially different (steeper) than the slopes of graphs 510 and 520. The reason for this may be that the pressure accumulator of graph 530 may be composed of a more compliant material than the accumulators of graphs 510 and 520. As a result, pressure does not increase in the accumulator of graph 530 in the same fashion as the accumulators of graphs 510 and 520. By modifying the degree of pre-pressurization in accumulator 502, DI pump efficiency may also be adjusted. If the DI pump uses most of its displacement to achieve the required injection pressure, the pump may be limited in its ability to supply the required fuel volumes at the required pressure. Pre-pressurizing accumulator 502 may aid the DI pump in achieving the required fuel volumes and pressures.

Figure 6:
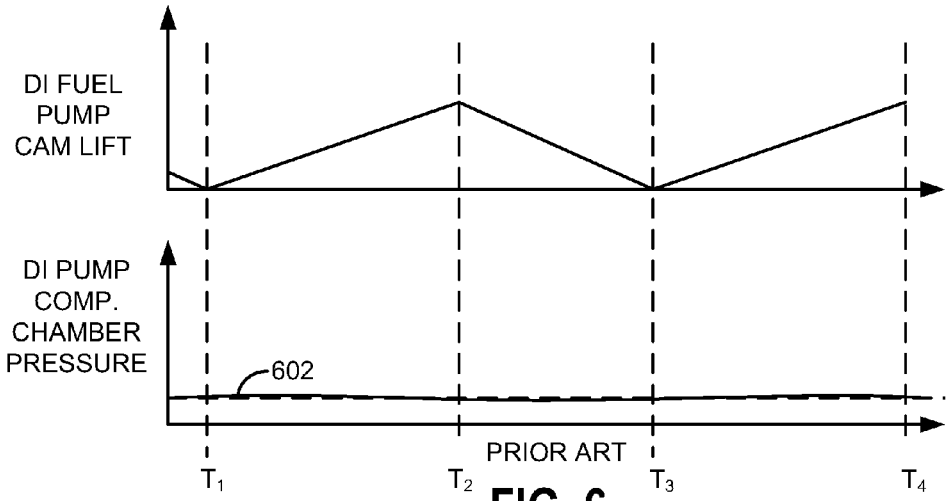
FIGS. 6-8 show example high pressure direct injection fuel pump operating sequences.

Referring now to FIG. 6, an example of prior art direct injection fuel pump operating sequence is shown. The sequence illustrates direct injection fuel pump operation when fuel flow out of the direct injection fuel pump to the direct injection fuel rail is ceased.

The first plot from the top of FIG. 6 shows direct injection fuel pump cam lift versus time. The Y axis represents direct injection fuel pump cam lift. The X axis represents time and time increases from the left side of FIG. 6 to the right side of FIG. 6. Cam lift is increases during a compression stroke for 100 crankshaft degrees. Cam lift decreases during the suction stroke for 80 crankshaft degrees.

The second plot from the top of FIG. 6 shows direct injection fuel pump compression chamber pressure versus time. The Y axis represents direct injection fuel pump compression chamber pressure. The X axis represents time and time increases from the left side of FIG. 6 to the right side of FIG. 6. Horizontal line 602 represents low pressure pump output pressure at the direct injection fuel pump compression chamber when the low pressure pump is operating, the solenoid activated check valve is in a pass-through state, and there is no net fuel flow to the fuel rail.

Vertical markers $T_1$-$T_4$ indicate time of interest during the direct injection fuel pump operating sequence. Time $T_1$ represents start of first direct injection fuel pump compression stroke. Time $T_2$ represents end of first direct injection fuel pump compression stroke and beginning of direct injection fuel pump suction stroke. Time $T_3$ represents end of first direct injection fuel pump suction stroke and beginning of a second compression stroke. Time $T_4$ represents the end of the second direct injection fuel pump compression stroke.

FIG. 6 shows that direct injection fuel pump compression chamber pressure is near low pressure fuel pump output pressure during first and second compression strokes as well as during first and second suction strokes. The solenoid activated check valve is operated in a pass through state so that the direct injection fuel pump does not pump fuel to the fuel rail. Fuel pressure at in the step-chamber is at low pressure fuel pump outlet pressure. Thus, little if any direct injection fuel pump lubrication is provided.

Figure 7:
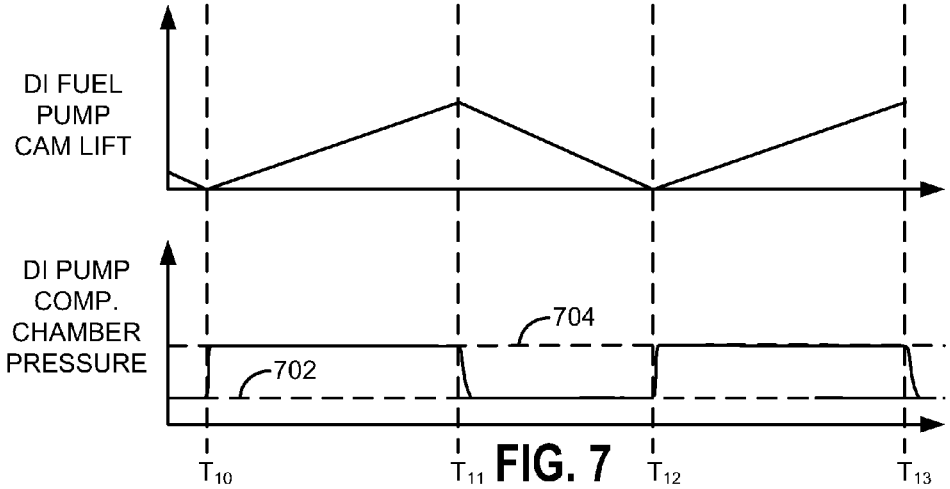

Referring now to FIG. 7, an example direct injection fuel pump operating sequence of the fuel pump shown in FIG. 4 is shown. The sequence illustrates direct injection fuel pump operation when fuel flow out of the direct injection fuel pump to the direct injection fuel rail is ceased.

The first plot from the top of FIG. 7 shows direct injection fuel pump cam lift versus time. The Y axis represents direct injection fuel pump cam lift. The X axis represents time and time increases from the left side of FIG. 7 to the right side of FIG. 7.

The second plot from the top of FIG. 7 shows direct injection fuel pump compression chamber pressure versus time. The Y axis represents direct injection fuel pump compression chamber pressure. The X axis represents time and time increases from the left side of FIG. 7 to the right side of FIG. 7. Horizontal line 702 represents low pressure pump output pressure Horizontal line 704 represents the pressure relief valve 401 of FIG. 4 is set to regulate.

Vertical markers $T_{10}$-$T_{13}$ indicate time of interest during the direct injection fuel pump operating sequence. Time $T_{10}$ represents start of first direct injection fuel pump compression stroke. Time $T_{11}$ represents end of first direct injection fuel pump compression stroke and beginning of direct injection fuel pump suction stroke. Time $T_{12}$ represents end of first direct injection fuel pump suction stroke and start of a second compression stroke. Time $T_{13}$ represents end of the second direct injection fuel pump compression stroke.

FIG. 7 shows that direct injection fuel pump compression chamber pressure increases during the first and second compression strokes. Pressure in the step-chamber (not shown) is at low pressure fuel pump output pressure during first and second compression strokes as well as during first and second suction strokes. Consequently, a pressure difference develops between the piston top and bottom allowing fuel to squeeze between the piston and the compression chamber walls lubricating the pump. The pressure difference decreases during the first suction stroke. Consequently, a reduced amount of lubrication may be provided during the suction stroke. Further, when cam lift is zero and the cam base circle is in mechanical communication with the piston, pressure in the compression chamber is reduced to pressure output of the low pressure pump supplying fuel to the direct injection fuel pump. The solenoid activated check valve is operated in a pass through state so that the direct injection fuel pump does not pump fuel to the fuel rail. Thus, during the compression stroke and part of the suction stroke, pressure in the direct injection fuel pump compression chamber is greater than low pressure pump outlet pressure. Consequently, direct injection fuel pump lubrication is increased as compared to the prior art.

Figure 8:
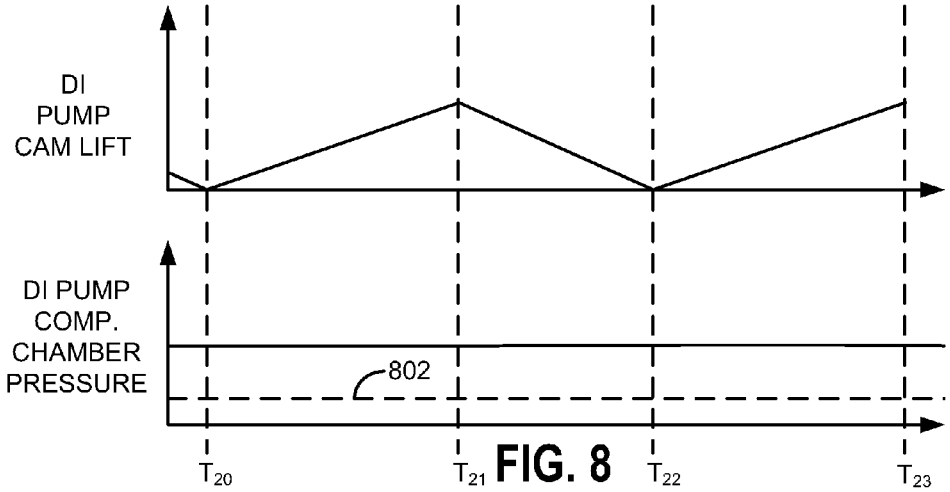
Figure 9:
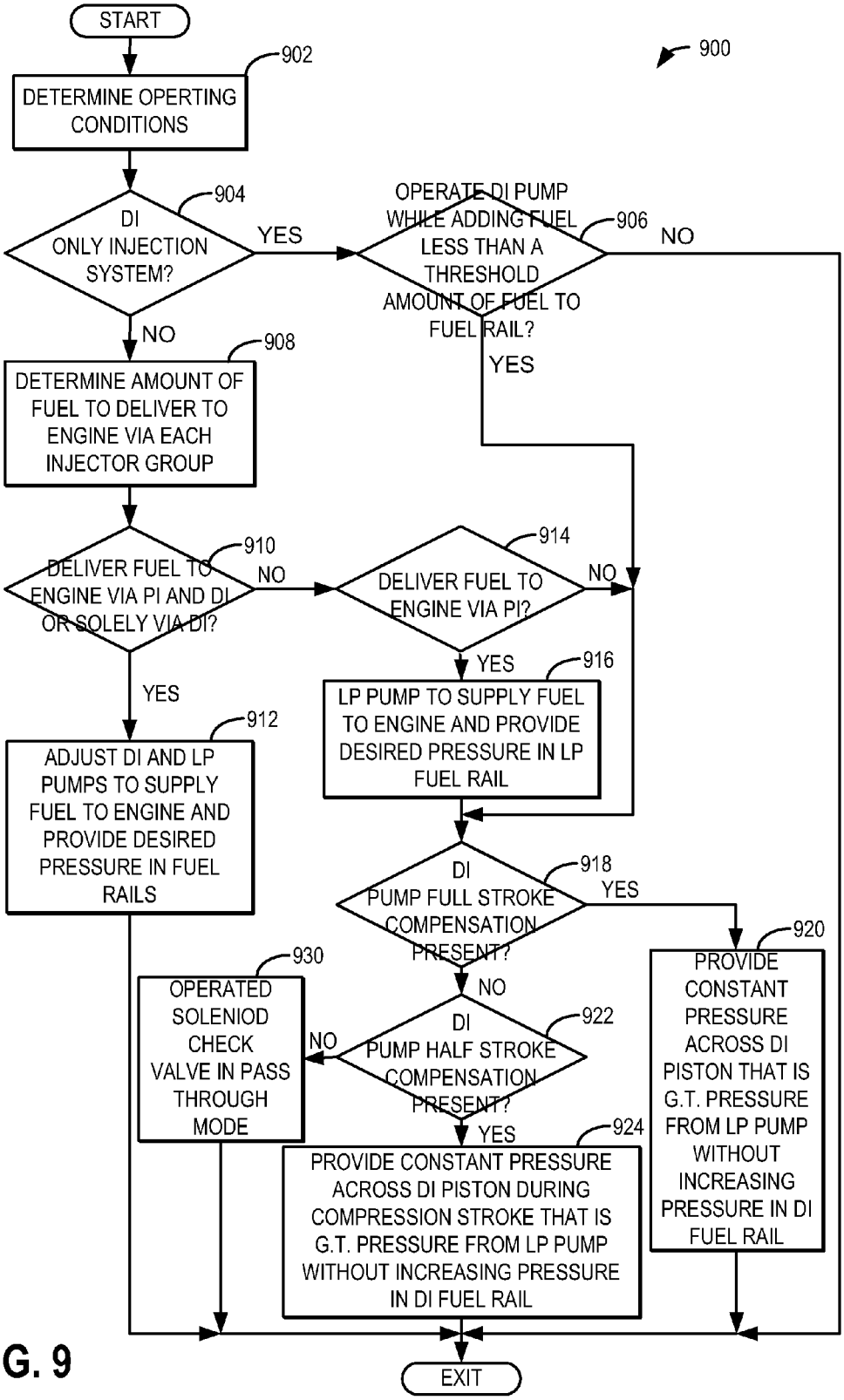
FIG. 9 shows an example flow chart of a method for operating a high pressure direct injection fuel pump.

Referring now to FIG. 8, an example direct injection fuel pump operating sequence of the fuel pump shown in FIG. 5A is shown. The sequence illustrates direct injection fuel pump operation when fuel flow out of the direct injection fuel pump to the direct injection fuel rail is ceased.

The first plot from the top of FIG. 8 shows direct injection fuel pump cam lift versus time. The Y axis represents direct injection fuel pump cam lift. The X axis represents time and time increases from the left side of FIG. 8 to the right side of FIG. 8.

The second plot from the top of FIG. 8 shows direct injection fuel pump compression chamber pressure versus time. The Y axis represents direct injection fuel pump compression chamber pressure. The X axis represents time and time increases from the left side of FIG. 8 to the right side of FIG. 8. Horizontal line 802 represents low pressure pump output pressure Vertical markers $T_{20}$-$T_{23}$ indicate time of interest during the direct injection fuel pump operating sequence. Time $T_{20}$ represents start of first direct injection fuel pump compression stroke. Time $T_{21}$ represents end of first direct injection fuel pump compression stroke and beginning of direct injection fuel pump suction stroke. Time $T_{22}$ represents end of first direct injection fuel pump suction stroke and start of a second compression stroke. Time $T_{23}$ represents end of the second direct injection fuel pump compression stroke.

FIG. 8 shows that direct injection fuel pump compression chamber pressure is elevated during the first and second compression strokes and during the first suction stroke. Thus, the pressure in the direct injection fuel pump compression chamber is substantially constant at a pressure greater than low pressure pump output pressure. The direct injection fuel pump pressure is at the constant elevated pressure after a first compression stroke of the direct injection fuel pump after the solenoid operated check valve is placed in a pass through mode. Consequently, a pressure difference develops between the piston top and bottom allowing fuel to squeeze between the piston and the compression chamber walls lubricating the pump. Accumulator 502 in FIG. 5A allows pressure in the compression chamber to stay substantially constant during the pump's suction stroke.

While this lube strategy cures an issue of lubrication ceasing when the DI system was in disuse, the lubrication that occurs in FIGS. 7 and 8 can even give better lubrication than if only a small fraction the pump's full displacement is being pumped out to the fuel rail.

Another feature is that in FIG. 8, since accumulator pressure is being used to "push down" the piston, the system conserves more energy than it would if controlled as is shown in FIG. 7. The reason for this is that the fluid pressure pushes with the same force on both the compression and intake strokes. If the pressure accumulator is pre-pressurized (as previously described with regard to FIG. 5A), the graph of FIG. 8 is raised, thus also raising the degree of pump lubrication.

Referring now to FIG. 9 a method for operating a direct injection fuel pump is shown. The method of FIG. 9 may be stored as executable instructions in non-transitory memory of controller 12 shown in FIGS. 1-5. The method of FIG. 9 may provide the sequences shown in FIGS. 7 and 8.

At 902, method 900 determines operating conditions. Operating conditions may include but are not limited to engine speed, engine load, vehicle speed, brake pedal position, engine temperature, ambient air temperature, and fuel rail pressure. Method 900 proceeds to 904 after operating conditions are determined.

At 904, method 900 judges whether or not the fuel system is a direct injection system only. If method 900 judges that there are no port injectors and the system is direct injection only, the answer is yes and method 900 proceeds to 906. Otherwise, the answer is no and method 900 proceeds to 908.

At 906, method 900 judges whether or not the piston in the direct injection fuel pump is reciprocating while less than a threshold amount of fuel is flowing into the direct injection fuel rail from the direct injection fuel pump. In one example, the threshold amount of fuel is zero. In another example, the threshold amount of fuel is an amount of fuel less than an amount of fuel to idle the engine. If method 900 judges that the piston in the direct injection fuel pump is reciprocating and less than a threshold amount of fuel is flowing into the direct injection fuel rail from the direct injection fuel pump, the answer is yes and method 900 proceeds to 918. Otherwise, the answer is no and method 900 proceeds to exit.

At 908, method 900 determines an amount of fuel to deliver to the engine via the direct injectors and an amount of fuel to deliver to the engine via the port fuel injectors. In one example, the amount of fuel to be delivered via port and direct injectors is empirically determined and stored in two tables or functions, one table for port injection amount and one table for direct injection amount. The two tables are indexed via engine speed and load. The tables output an amount of fuel to inject to engine cylinders each cylinder cycle. Method 900 proceeds to 910 after determining the amounts of fuel to directly inject and port inject.

At 910, whether or not to deliver fuel to the engine via port and direct injectors or solely via direct injectors. In one example, method 900 judges whether or not to deliver fuel to the engine via port and direct injectors or solely via direct injectors based on output from tables at 908. If method 900 judges to deliver fuel to the engine via port and direct injectors or solely via direct injectors, the answer is yes and method 900 proceeds to 912. Otherwise, the answer is no and fuel is not injected via direct injectors while the engine is rotating and the direct injection fuel pump piston is reciprocating. Method 900 proceeds to 914 when the answer is no.

At 912, method 900 adjusts the duty cycle of a signal supplied to the solenoid activated check valve 412 in FIGS. 4 and 5 to adjust flow through the direct injection fuel pump so as to provide the amount of fuel desired to be directly injected and to provide the desired fuel pressure in the direct injection fuel rail. The solenoid activated check valve duty cycle controls how much of the pump's actual displacement is being engaged to pump fuel. In one example, the duty cycle is increased to increase flow through the direct injection fuel pump and to the direct injection fuel rail. If the fuel system includes a single low pressure fuel pump, the low pressure fuel pump command is adjusted in response to the amount of fuel to be delivered to the engine. For example, low pressure fuel pump output is increased as the amount of fuel injected to the engine is increased. If the fuel system includes two low pressure fuel pumps, the first low pressure fuel pump output is adjusted in response to the amount of fuel injected by the port fuel injectors. The second low pressure fuel pump output is adjusted in response to the amount of fuel injected by the direct fuel injectors. Fuel is then supplied to the engine via the port and direct fuel injectors. Method 900 proceeds to exit after the direct and low pressure pumps are adjusted.

At 914, method 900 judges whether or not to deliver fuel to the engine via port injectors. In one example, method 900 judges to deliver fuel to the engine via only port injectors based on the output of the two tables at 908. If the direct fuel injection amount is zero or less than a threshold amount of fuel necessary for the engine to operate at idle speed and port injection is requested, method 900 proceeds to 916. Otherwise, port fuel injection and direct fuel injection are not requested and method 900 proceeds to 918. Port fuel injection and direct fuel injection may not be requested during low engine load conditions such as when the vehicle is decelerating or traveling downhill.

At 916, method 900 adjusts low pressure fuel pump output. If the fuel system includes only a single low pressure fuel pump, the low pressure fuel pump output is adjusted in response to the amount of port fuel injected and the desired port injector fuel rail pressure. If the fuel system includes two low pressure fuel pumps, the first low pressure fuel pump output is adjusted in response to the amount of fuel injected by the port fuel injectors and the port injector fuel rail pressure. The second low pressure fuel pump output is adjusted in response to fuel pressure in a passage that provides fluidic communication between the low pressure fuel pump and the direct injection fuel pump. In particular, the low pressure pump command is adjusted in response to fuel pressure between the low pressure fuel pump and the direct injection fuel pump. Fuel is then injected to the engine via the port fuel injectors and not via the direct fuel injectors.

At 918, method 900 judges whether or not to supply direct injection fuel pump full cam stroke (e.g., compression stroke and suction stroke, and in some examples while the piston is in communication with a cam's base circle) fuel pump lubrication. In one example, method 900 judges whether or not to supply direct injection fuel pump full cam stroke lubrication based on whether or not accumulator 502 of FIG. 5A is included in the direct injection fuel pump or fuel system. If the accumulator is present and fuel flow from the direct injection fuel pump is less than a threshold fuel flow rate, the answer is yes and method 900 proceeds to 920. Otherwise, the answer is no and method 900 proceeds to 922.

At 920, method 900 regulates fuel pressure in the direct injection fuel pump compression chamber via a pressure relief valve 401 and accumulator 502 as shown in FIG. 5A, although other regulation schemes are also envisioned. The fuel pressure in the compression chamber is regulated to a single pressure that is greater than pressure output of the low pressure fuel pump that is supplying fuel to the direct injection fuel pump. By regulating pressure in the compression chamber a pressure differential between the direct injection fuel pump piston's top and bottom develops and fuel flow from the piston top to bottom provides lubrication to the direct injection fuel pump. At the same time, fuel flow out of the direct injection fuel pump to the direct injection fuel rail is stopped because pressure in the direct fuel injection fuel rail is greater than direct injection fuel pump output pressure. Consequently, the direct fuel injection pump is lubricated without raising direct injection fuel rail pressure. Additionally, direct injection fuel pump lubrication is provided when fuel flow through the direct fuel injectors is stopped. In this way, the direct injection fuel pump may be lubricated while direct fuel injection fuel pump output to the fuel rail is zero or less than a threshold fuel flow rate. Method 900 proceeds to exit after full cam stroke lubrication begins.

At 922, method 900 judges whether or not to supply direct injection fuel pump half cam stroke (e.g., compression stroke) fuel pump lubrication. In one example, method 900 judges whether or not to supply direct injection fuel pump full cam stroke lubrication based on whether or not pressure relief valve 401 of FIG. 4 is included in the direct injection fuel pump or fuel system. If the pressure relief valve is present and fuel flow from the direct injection fuel pump is less than a threshold fuel flow rate, the answer is yes and method 900 proceeds to 924. Otherwise, the answer is no and method 900 proceeds to 930.

At 930, method 900 opens the solenoid activated check valve 412 shown in FIGS. 4 and 5 to allow the check valve to operate as a pass through device. The direct injection fuel pump does not develop fuel pressure at outlet 404 when the solenoid activated check valve is operated in a pass through mode. Consequently, the direct injection fuel rail pressure does not increase; however, the direct injection fuel pump may be operated in this state for a limited amount of time to limit direct injection fuel pump degradation. Method 900 proceeds to exit after the solenoid activated check valve is operated in a pass through mode.

At 924, method 900 regulates fuel pressure in the direct injection fuel pump compression chamber via a pressure relief valve 401 as shown in FIG. 4, although other regulation schemes are also envisioned. The fuel pressure in the compression chamber is regulated to a single pressure during the pump's compression stroke that is greater than pressure output of the low pressure fuel pump that is supplying fuel to the direct injection fuel pump. By regulating pressure in the compression chamber a pressure differential between the direct injection fuel pump piston's top and bottom develops and fuel flow from the piston top to bottom provides lubrication to the direct injection fuel pump. At the same time, fuel flow out of the direct injection fuel pump to the direct injection fuel rail is stopped because pressure in the direct fuel injection fuel rail is greater than direct injection fuel pump output pressure. Consequently, the direct fuel injection pump is lubricated without raising direct injection fuel rail pressure. Additionally, direct injection fuel pump lubrication is provided when fuel flow through the direct fuel injectors is stopped. In this way, the direct injection fuel pump may be lubricated while direct fuel injection fuel pump output to the fuel rail is zero or less than a threshold fuel flow rate. Method 900 proceeds to exit after half cam stroke lubrication begins.

As a summary of method 900 of FIG. 9, when the pump is maintaining sufficient pressure to support injection via the direct injectors, the solenoid activated inlet check valve is not energized (un-energized or de-energized). As such, the solenoid valve may not be required to be energized during direct injection idling or port fuel injection idling conditions. During this method of operation, the minimum pump lubrication requirement may be ensured by the mechanical arrangement of the pump system.

Figure 10:
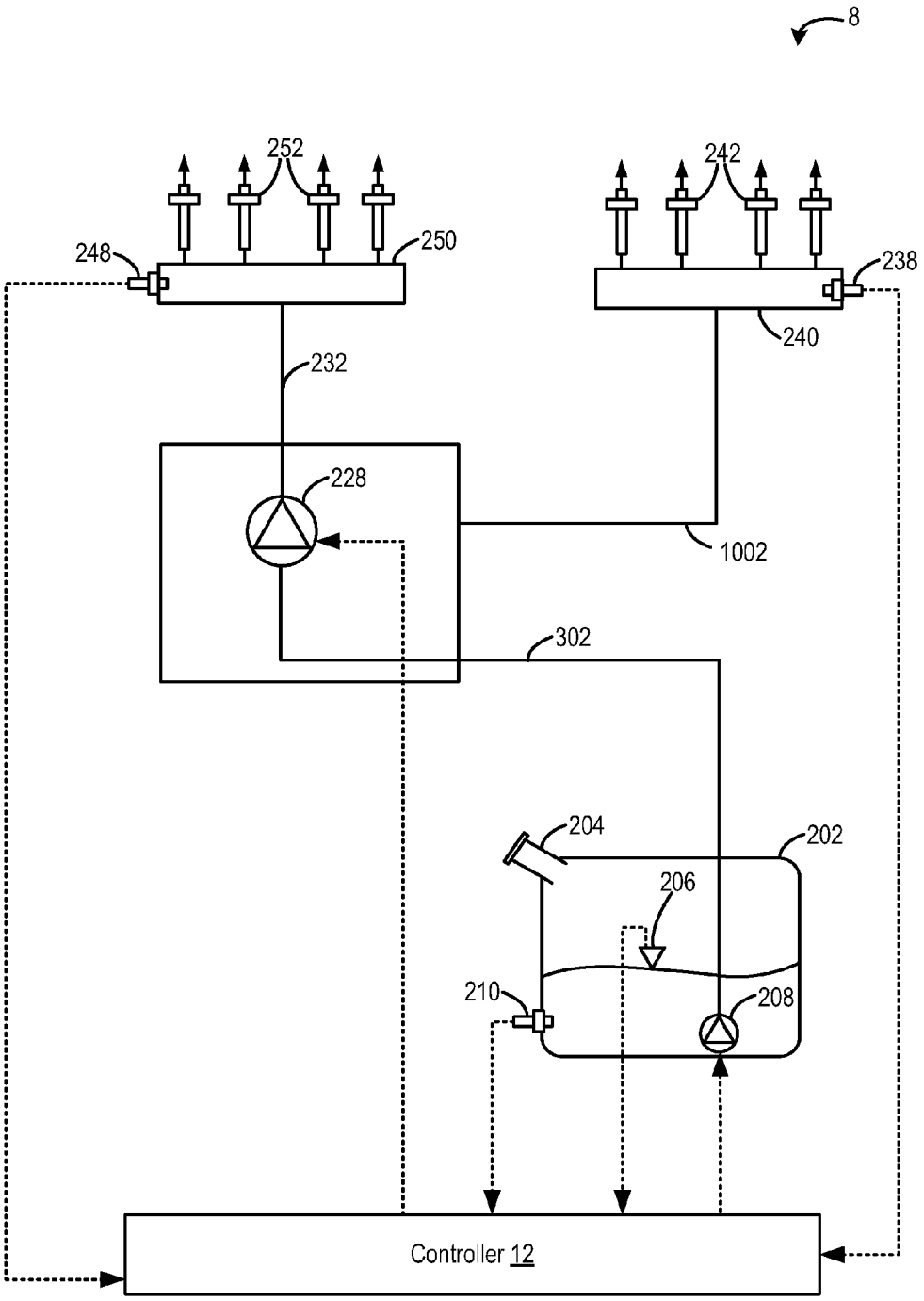
FIG. 10 shows an alternative example fuel system that may be used with the engine of FIG. 1.

Referring now to FIG. 10, is shows a second example fuel system for supplying fuel to engine 10 of FIG. 1. Many devices and/or components in the fuel system of FIG. 10 are the same as devices and/or components shown in FIG. 2. Therefore, for the sake of brevity, devices and components of the fuel system of FIG. 2, and that are included in the fuel system of FIG. 10, are labeled the same and the description of these devices and components is omitted in the description of FIG. 10.

The fuel system of FIG. 10 shows fuel passage 1002 leading from fuel pump 228 to port fuel injection rail 240 and fuel injectors 242. Fuel passage 1002 allows fuel to come in contact with both the step room and pump's compression chamber. The fuel then may pick up heat and exit to the PI fuel system as shown. That fuel enters and exits the high pressure pump; however, the fuel enters and exits at lift pump pressure (e.g., the same pressure as output by low pressure fuel pump 208).

Figure 11:
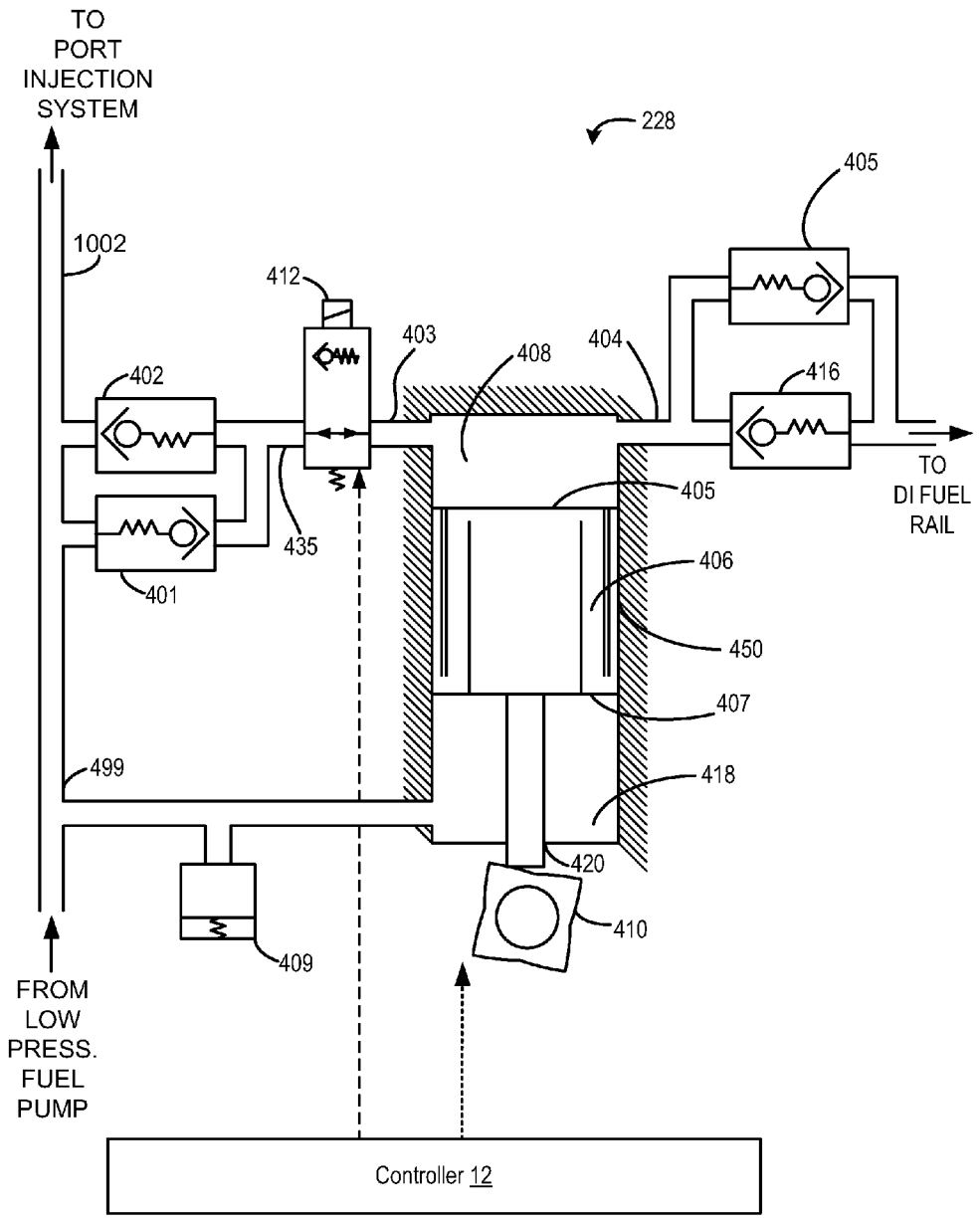
FIG. 11 shows an alternative example high pressure direct injection fuel pump of the fuel system of FIG. 10.

FIG. 11 shows another example direct injection fuel pump 228 is shown. Many devices and/or components in the direct injection fuel pump of FIG. 11 are the same as devices and/or components shown in FIG. 4. Therefore, for the sake of brevity, devices and components of the direct fuel injection pump of FIG. 4, and that are included in the direct injection fuel pump of FIG. 11, are labeled the same and the description of these devices and components is omitted in the description of FIG. 11.

The fuel pump of FIG. 11 includes fuel passage 1002 which allows fuel to come into contact with step room 418 and pump compression chamber 408 before proceeding to port fuel injectors. By allowing fuel to come into contact with portions of high pressure fuel pump 228, it may be possible to cool high pressure fuel pump 228.

Thus, one of the example pumps shown in FIG. 4, 5, or 11 may be selected and fuel rail pressure greater than lift pump pressure may be provided via engaging the solenoid operated check valve.

Another example of a direct injection (DI) fuel pump 228 is presented in FIG. 12, wherein an accumulator 425 is included as part of a different configuration than pump 228 of FIG. 5A. Many devices and/or components in the direct injection fuel pump of FIG. 12 are the same as devices and/or components shown in FIG. 5A. Therefore, for the sake of brevity, devices and components of the direct fuel injection pump of FIG. 5A, and that are included in the direct injection fuel pump of FIG. 12, are labeled the same and the description of these devices and components is omitted in the description of FIG. 12.

Accumulator 425 is different than accumulator 502 of FIG. 5A in that accumulator 425 comprises the shape of a dead volume or clearance volume, wherein it is an added, rigid container comprising a vacuous interior volume with no additional components. The utility of the dead volume arises from the compliance of a fluid in the rigid container of the dead volume. Accumulator 425 may range in size depending on the fuel system used, and in this embodiment, the accumulator has a volume of 30 cc. Furthermore, in FIG. 5A the apparent fluid compliance is a result of an effectively incompressible fluid (the fuel) acting on a container with compliance, or pressure accumulator 502. In FIG. 12, the apparent fluid compliance results from an effectively compressible fluid (the fuel) acting on a rigid container, or dead volume 425.

The addition of the accumulator affects the pump system in several ways. One feature is that as the size of the interior volume of the accumulator increases, peak or maximum (upper threshold) compression chamber pressure within the DI pump is reduced. This is shown by the equation for the bulk modulus of a substance, the substance being fuel in this case. A form of the equation may be written as $dP=K*(dV/(V+dV))$, where dV is the pump displacement, K is the fuel's bulk modulus, V is the clearance volume, and dP is the change in pressure. Assuming in this example that gasoline is the fuel used, its bulk modulus can be estimated as 1300 MPa. The typical displacement of a DI pump may be assumed as 0.25 cc. For the same DI pump, its clearance volume without the added dead volume is 1.4 cc. With an added dead volume, the clearance volume of the pump is effectively increased, and may increase to a value such as 30 cc or greater. As seen in the bulk modulus equation, as clearance volume V increases, the change in pressure is reduced, resulting in a reduced maximum compression chamber pressure. In this way, dead volume 425 serves a similar function as pressure relief valve 401 in FIG. 5A. It is noted that the pressure change dP given above may be dependent on several other factors besides what is presently given. Other factors may include pump piston leakage and check valve volume loss. However, the general relationship between dead volume size and pressure change remains the same.

Figure 13:
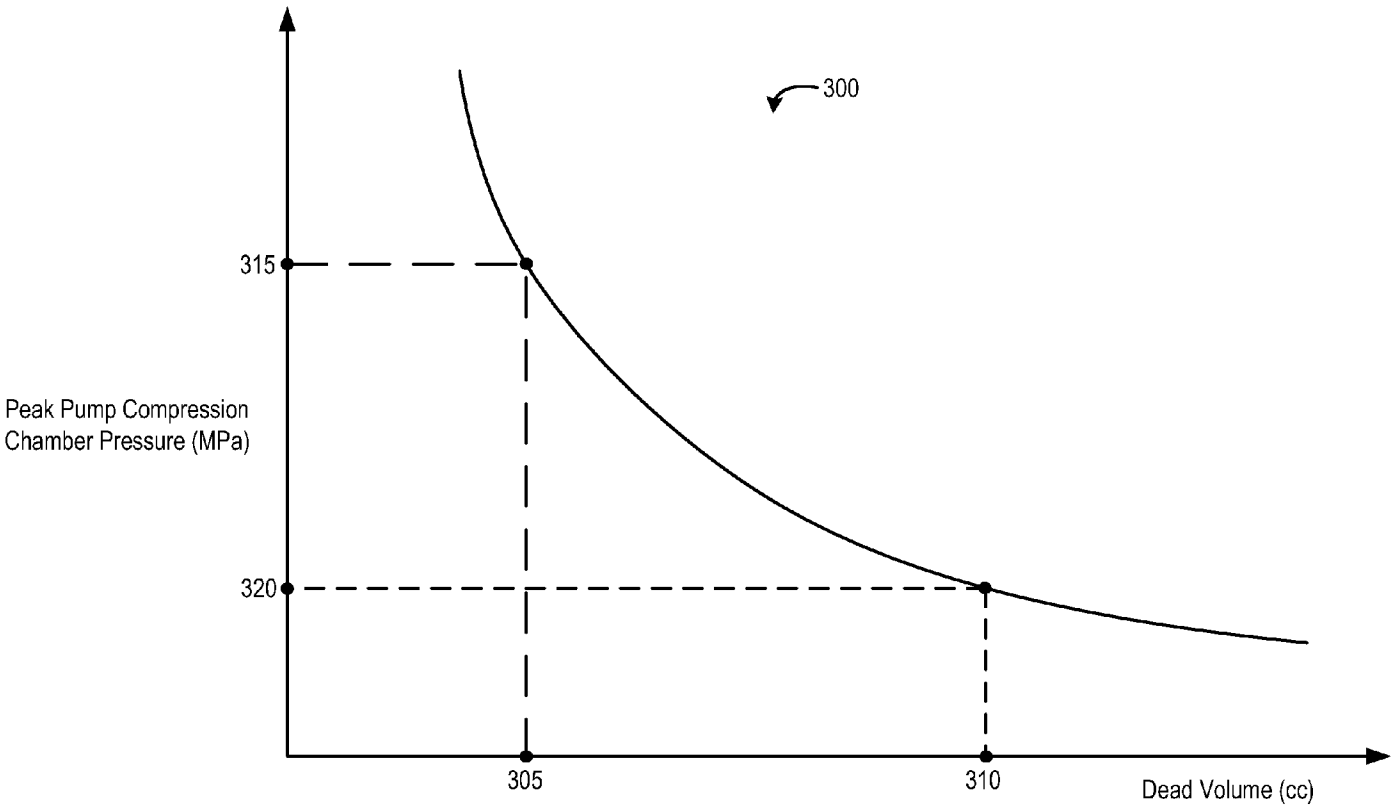
FIG. 13 shows a relationship between an accumulator volume and a pressure inside a pump compression chamber.
Figure 14:
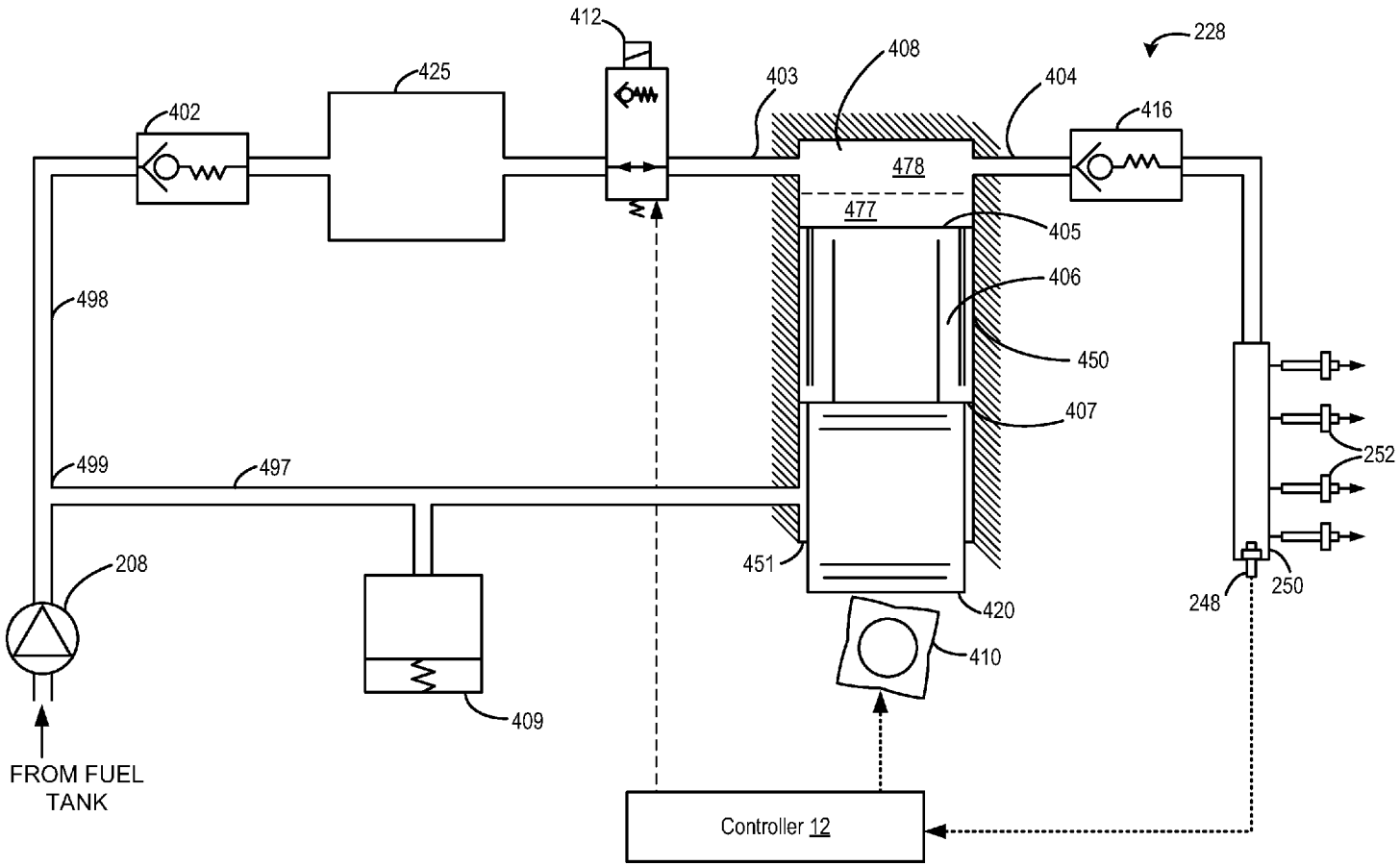
FIG. 14 shows another example of a high pressure direct injection fuel pump of the fuel system of FIGS. 2 and 3.

The relationship between dead volume (accumulator) size and maximum compression chamber pressure can be seen in FIG. 13, where dead volume size is presented as the horizontal axis and peak pump compression chamber pressure is presented as the vertical axis. Graph 300 shows that as the size of the dead volume increases, peak pump compression chamber pressure decreases accordingly. As example approximate values that form points along graph 300, point 305 represents 15 cc while point 315 represents a 20 MPa pressure. Similarly, point 310 represents 30 cc while point 320 represents a 10 MPa pressure.

The inventors herein have recognized that selectably adding dead volume 425 to pump 228 may decrease pressure response time of the pump. In response to this, optional check valve 430 may be added in series with accumulator 425 in order to prevent degradation of pump response time, as seen in FIG. 12. The addition of check valve 430 achieves this result while still allowing dead volume 425 to limit pump compression chamber pressure. As seen in FIG. 12, check valve 430 and accumulator 425 are located in series along a conduit that is separate from pump passage 435, on which solenoid valve 412 is located.

It is known from FIG. 5A that when solenoid operated check valve 412 is deactivated (de-energized), pressure relief valve 401 is allowed to regulate the pressure in compression chamber 408, wherein the relief valve is rated to a certain pressure (such as 15 bar). In light of the aforementioned bulk modulus equation and the result that dead volume 425 limits the increase in compression chamber pressure, relief valve 401 is effectively replaced by dead volume 425 since they serve substantially the same purpose. As seen in FIG. 12, the compression relief valve 401 of FIG. 5A is removed since dead volume 425 replaces the relief valve's function of limiting the pump compression chamber pressure. Alternatively, relief valve 401 may be optionally included in the system of FIG. 12, but its function is substantially redundant. Dead volume 425 becomes hydraulically active when pump compression chamber pressure exceeds the pressure contained within dead volume 425.

Pump 228 of FIG. 12 also includes a leak orifice 431 located in parallel with check valve 430 that may allow pump chamber pressure to increase with engine and pump speed. Furthermore, leak orifice 431 may prevent a gradual pressure build above the desired compression chamber pressure limit. Leak orifice 431 allows trapped fluid within dead volume 425 to slowly leak back into pump passage 435. It is noted here that both check valve 430 and leak orifice 431 are optional; the addition of which may aid in tuning the pressure of pump 228 and flow characteristic when solenoid valve 412 is de-energized. Furthermore, components 430 and 431 may produce an effect similar to the aforementioned process of pre-pressurizing accumulator 502.

For general operation of DI pump 228 with accumulator 425, the solenoid activated check valve 412 must be commanded to a pass-through (deactivated) state during the pump compression stroke so accumulator 425 may be in fluidic connection with pump compression chamber 408. In this configuration, the added 30 cc of volume of accumulator 425 may be added to the smaller clearance volume (1.4 cc) of pump 228 to provide pressure and fuel to the pump.

The inventors herein have recognized that direct injection fuel pumps may exhibit an event known as reflux. Reflux may occur in piston-operated pumps such as DI pumps 228 shown in FIGS. 4, 5A, 11, and 12, wherein a portion of the pumped liquid (fuel in this case) is repeatedly forced into and out of the top and bottom of the pump piston into a low pressure fuel line. In the present description, the DI fuel pump may be fluidly connected to the low pressure line from both the top and bottom of the piston, as seen in FIG. 12. The low pressure fuel line may contain multiple branches that are located on the inlet side of the pump, or equivalently upstream of the pump.

The progression of pump reflux is described as follows. During the pump's compression stroke, as the pump piston is traveling from bottom dead center (BDC) to top dead center (TDC), two reflux events may occur. First, fluid may be forced from the top of the piston backward into the low pressure line. Second, fluid may be sucked from the low pressure line to the volume under the piston. The volume under the piston, also known as step room 418 as seen in FIG. 12, is created by a difference in diameters between the piston 406 and piston rod 420 (or stem). The piston rod may have a smaller diameter than the diameter of the piston, as may be the configuration for many direct injection fuel pumps. As a result of the discrepancy between diameters, the piston rod has a smaller volume than that of the piston, thereby causing the empty volume (lack of material) on the bottom side of the piston.

During the pump's suction (intake) stroke, as the pump piston is traveling from TDC to BDC, two additional reflux events may occur. First, fluid may be forced from the bottom of the piston (the volume under the piston, step room 418) backward into the low pressure line. Second, fluid may be sucked from the low pressure line to the top of the piston (into compression chamber 408).

The effect of the pump reflux, or transient fuel flows on the top and bottom of the piston, may excite the natural frequency of the low pressure fuel supply line, since the low pressure fuel supply line may be connected to the back of the pump piston as well as the top of the piston, as seen in FIG. 12. The repeated, reversing fuel flow on both sides of the piston may create fuel pressure and flow pulsations that may at least partially cause a number of issues. One of these issues may be increased noise caused by the flow pulsations, thereby requiring additional sound reduction components that may otherwise be unnecessary. Another issue may be requiring increasing of the mean lift pump pressure to counteract the fuel pulsations. Furthermore, additional mechanical stress may be caused in the pump and fuel system that would require expensive preventative systems and/or expensive repairs if physical component failure occurs. Other related issues not explained herein may be caused by pump reflux.

The inventors herein have recognized the above-mentioned issue may be at least partly addressed by a modified high pressure pump (and related system components) that includes adding a dead volume and check valve, as previously discussed with reference to FIG. 12, and a change in the size of the piston rod. These physical modifications may be combined to create a different pump system than those shown in FIGS. 4, 5A, 11, and 12.

FIG. 14 shows a modified pump system that may limit the severity of pump reflux, the issues associated with which were previously described. Many devices and/or components in the direct injection fuel pump of FIG. 14 are the same as devices and/or components shown in FIG. 12. Therefore, for the sake of brevity, devices and components of the direct fuel injection pump of FIG. 12, and that are included in the direct injection fuel pump of FIG. 14, are labeled the same and the description of these devices and components is omitted in the description of FIG. 14. Accumulator 425 of FIG. 14 is substantially the same as accumulator 425 of FIG. 12, located in a different position.

Different from the DI pump of FIG. 12, direct injection fuel rail 250 is shown in FIG. 14 along with several direct injectors 252 and fuel composition sensor 248 which is shown as being connected to controller 12. In other embodiments, sensor 248 may be a different sensor such as a fuel rail pressure sensor or other suitable sensor, as dictated by the requirements of the particular fuel system.

The fuel pump 228 of FIG. 14 may attempt to mitigate the severity of pump reflux via several changed and added features, as described herein. First, check valve 402 may be added downstream of pump inlet 499, where one purpose of valve 402 may be to prevent (stop) fuel from flowing out of pump chamber 408 back into low pressure line 498. Second, dead volume 425, substantially the same as dead volume 425 of FIG. 12, may be positioned immediately downstream of check valve 402. As such, check valve 402 and dead volume 425 may be aligned in series with solenoid activated inlet check valve 412, all upstream of inlet 403 of the DI pump compression chamber. Dead volume 425 may be of a discrete volume, such as 10 cc or another suitable value for the DI pump system.

As mentioned previously, dead volume 425 effectively adds to the clearance volume of the DI pump, labelled in FIG. 14 as clearance volume 478. A common value for the clearance volume of a DI pump may be 3 cc. The displacement of the DI pump, or volume swept by piston 406 as it moves from TDC to BDC or vice versa, is labelled as pump displacement 477. Again, a typical value for a DI pump's displacement may be 0.25 cc. To reiterate, the issues associated with pump reflux are two-fold. Fuel may be repeatedly expelled from and sucked into the top 405 and bottom 407 of piston 406, thereby creating unwanted pressure and fuel flow pulsations. The addition of check valve 402 and dead volume 425 may result in reduced or eliminated pump reflux where fuel is not allowed to flow into low pressure line 498 by check valve 402, and fuel pressure generated from compression chamber 408 may be directed into dead volume 425, which acts as a storage reservoir that piston 406 may push fuel against while solenoid activated check valve 412 is de-energized (open to flow). The system shown in FIG. 14 may reduce or eliminate pressure pulsations while preventing fluid from flowing from compression chamber 408 into low pressure line 498.

However, pump reflux may still occur on the bottom side 407 of piston 406. As described above, many DI pumps include a piston 406 with a larger diameter than the piston rod 420 (or piston stem), the rod configured to be in contact with a receiving motion from cam 410. As such, a stem room 418 (as seen in FIG. 12) may be formed by the difference between volumes of the piston and stem. In effect, step room 418 may act as a compression chamber on the backside of piston 406 that pressurizes the fuel opposite to compression chamber 408. As described previously, pump reflux may result from the reciprocating change in volume of step room 418.

Turning again to FIG. 14, another feature may be included in pump 228, which is changing the size of stem 420. In this embodiment, the outside diameter of stem 420 is equal or substantially equal to the outside diameter of piston 406. To easily differentiate between the stem and piston in FIG. 14, the diameter of stem 420 is shown to be slightly smaller than the diameter of piston 406, when in reality the diameters are equal. From this, step room 18 of FIG. 12 may be consumed by stem 420 in FIG. 14, thereby eliminating the compression chamber (step room 418) on the backside of piston 406. In other words, no vacuous volume is present on the backside of piston 406 in between the piston and the stem throughout movement of the piston. Additionally, no vacuous volume is present anywhere around the stem inside the volume defined by cylinder wall 450 and cylinder bottom 451. In this way, as piston 406 (and the stem) move from TDC to BDC and vice versa, substantially no fuel may be expelled into and sucked from low pressure line 497, thereby reducing or eliminating pulsations (pump reflux) on the underside of piston 406.

By diminishing or removing pump reflux, several benefits may emerge. First, during idling conditions that involve either or both of modified PFI and DI operation, the pump may produce less than noise while the solenoid actuated check valve is de-energized as compared to a pump without the changed and added features of FIG. 14. Additionally, during idling conditions, the pump may maintain lubrication while no fuel is being passed through check valve 416 and into fuel rail 250 (zero flow rate). Lastly, as dead volume 425 may be changed in size according to fuel system requirements, an increased dead volume may result in enabling pressure regulation of DI pump 228, in that excess pressure may accumulate in dead volume 425 rather than in fuel rail 250. Dead volume 425 as shown in FIG. 14 is an empty chamber, a component which may be substantially less expensive than other, more complicated components. In this way, the addition of costly pressure regulation devices may be unnecessary.

It is understood that the embodiment of DI pump 228 and related features shown in FIG. 14 is meant to be one example of multiple possible configurations in an illustrative and non-limiting sense. Features and components of FIG. 14 may be moved and/or alternated while still maintaining the general result described herein, that is, reducing or eliminating pump reflux on the top and bottom of piston 406 through geometrical changes to pump components and addition of other pump components.

Summarizing, the addition of dead volume 425 and check valve 402, along with the equal diameters of piston 406 and stem 420 may substantially prevent backward fluid flow into the low pressure supply side (low pressure fuel lines 497 and 498), thus reducing pressure pulsations. These additional features, as shown in FIG. 14 as well as in FIG. 12 (with leak orifice 431), may aid in alleviating the adverse effects associated with pump reflux, pump noise pollution, and insufficient pump lubrication. Furthermore, as increased lift pump pressure may be required to overcome fuel pulsations caused by pump reflux, the addition of the aforementioned components may reduce the energy required by the pump system as fuel pulsations are reduced.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating a direct injection fuel pump, comprising:

while a solenoid activated check valve at an inlet of the direct injection fuel pump is commanded to a pass-through state during a direct injection fuel pump compression stroke, an accumulator located upstream of the solenoid activated check valve is in fluidic communication with a compression chamber of the direct injection fuel pump, the accumulator adding a volume to a clearance volume of the direct injection fuel pump.

2. The method of claim 1, further comprising a pressure in the compression chamber of the direct injection fuel pump, the pressure providing a differential pressure greater than a threshold differential pressure between a top and a bottom of a piston of the pump during the direct injection fuel pump compression stroke.

3. The method of claim 2, wherein the pressure is regulated via the accumulator as it provides fuel and pressure to the compression chamber of the direct injection fuel pump.

4. The method of claim 1, wherein as an interior volume of the accumulator increases an upper threshold pressure in the compression chamber of the direct injection fuel pump decreases.

5. The method of claim 1, wherein a check valve is located in between the accumulator and the solenoid activated check valve.

6. The method of claim 5, wherein a leak orifice is placed in parallel with the check valve.

7. The method of claim 1, wherein the direct injection fuel pump is driven via a cam.

8. A fuel system, comprising:

a direct injection fuel pump including a piston, compression chamber, and a cam for driving the piston;

a first solenoid activated check valve positioned at an inlet of the direct injection fuel pump for regulating fuel flow;

a second check valve positioned upstream of the first solenoid activated check valve; and an accumulator positioned upstream of the second check valve, the accumulator adding to a clearance volume of the direct injection fuel pump.

9. The fuel system of claim 8, wherein the accumulator is positioned in series with the second check valve on a separate conduit than the solenoid activated check valve.

10. The fuel system of claim 8, further comprising a leak orifice positioned in parallel with the second check valve.

11. The fuel system of claim 8, further comprising a controller including instructions to operate the first solenoid activated check valve to regulate fuel flow through the direct injection fuel pump.

* * * * *